US011111921B2

(12) United States Patent
Doepker et al.

(10) Patent No.: US 11,111,921 B2
(45) Date of Patent: Sep. 7, 2021

(54) CO-ROTATING COMPRESSOR

(71) Applicant: Emerson Climate Technologies, Inc., Sidney, OH (US)

(72) Inventors: Roy J. Doepker, Lima, OH (US); Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 714 days.

(21) Appl. No.: 15/425,266

(22) Filed: Feb. 6, 2017

(65) Prior Publication Data

US 2018/0223843 A1 Aug. 9, 2018

(51) Int. Cl.
*F04C 18/02* (2006.01)
*F04C 29/00* (2006.01)
(Continued)

(52) U.S. Cl.
CPC ..... *F04C 18/0238* (2013.01); *F04C 18/0261* (2013.01); *F04C 27/001* (2013.01);
(Continued)

(58) Field of Classification Search
CPC ... F04C 18/023–18/0238; F04C 23/008; F04C 29/02–29/028; F04C 18/0223;
(Continued)

(56) References Cited

U.S. PATENT DOCUMENTS 2,415,011 A * 1/1947 Hubacker ..... F04C 18/46 417/256
2,420,124 A * 5/1947 Chilton ..... F04C 18/322 417/356
(Continued)

FOREIGN PATENT DOCUMENTS

CN 101682226 A 3/2010
CN 102480197 A 5/2012
(Continued)

OTHER PUBLICATIONS

Office Action regarding U.S. Appl. No. 15/205,907, dated May 29, 2018.
(Continued)

*Primary Examiner* — Alexander B Comley
(74) *Attorney, Agent, or Firm* — Harness, Dickey & Pierce, P.L.C.

(57) ABSTRACT

A compressor may include first and second scroll members, first and second bearing housings, and a motor assembly. The first scroll member includes a first end plate and a first spiral wrap extending from the first end plate. The second scroll member includes a second end plate and a second spiral wrap extending from the second end plate and intermeshed with the first spiral wrap to define compression pockets therebetween. The first bearing housing supports the first scroll member for rotation about a first rotational axis. The second bearing housing may support the second scroll member for rotation about a second rotational axis that is parallel to and offset from the first rotational axis. The motor assembly may be disposed axially between the first and second bearing housings and may include a rotor attached to the first scroll member. The rotor may surround the first and second end plates.

15 Claims, 10 Drawing Sheets

(51) Int. Cl.
*F04C 29/12* (2006.01)
*F04C 27/00* (2006.01)
*F04C 29/02* (2006.01)

(52) U.S. Cl.
CPC ..... *F04C 29/0085* (2013.01); *F04C 29/02* (2013.01); *F04C 29/12* (2013.01); *F04C 2240/30* (2013.01); *F04C 2240/40* (2013.01); *F04C 2240/50* (2013.01)

(58) Field of Classification Search
CPC ..... F04C 18/0261; F04C 27/001; F04C 29/0085; F04C 2240/30; F04C 2240/40; F04C 2240/50
USPC ..... 417/353, 355, 356, 410.1, 410.3–410.5; 418/55.1–55.6, 57, 60, 188
See application file for complete search history.

(56) References Cited

U.S. PATENT DOCUMENTS 2,440,593 A * 4/1948 Miller ..... F04C 18/324 418/88
4,105,374 A 8/1978 Scharf
4,753,582 A * 6/1988 Morishita ..... F01C 21/102 418/188
4,781,550 A * 11/1988 Morishita ..... F04C 18/023 418/188
4,846,639 A * 7/1989 Morishita ..... F04C 18/023 418/55.5
4,927,339 A 5/1990 Riffe et al.
4,927,340 A 5/1990 McCullough
4,950,135 A * 8/1990 Tojo ..... F01C 17/00 310/323.02
5,002,470 A * 3/1991 Gormley ..... F04C 18/0223 417/410.5
5,051,075 A 9/1991 Young
5,069,605 A * 12/1991 Saitoh ..... F04C 18/0215 418/143
5,073,093 A * 12/1991 Takagi ..... F04C 18/0215 417/410.5
5,090,876 A * 2/1992 Hashizume ..... F04C 18/023 417/366
5,099,658 A 3/1992 Utter et al.
5,123,818 A * 6/1992 Gormley ..... F04C 18/0223 417/410.5
5,129,798 A 7/1992 Crum et al.
5,141,421 A 8/1992 Bush et al.
5,142,885 A 9/1992 Utter et al.
5,149,255 A 9/1992 Young
5,178,526 A 1/1993 Galante et al.
5,199,280 A 4/1993 Riffe et al.
5,211,031 A 5/1993 Murayama et al.
5,242,284 A * 9/1993 Mitsunaga ..... F04C 27/005 418/55.3
5,256,042 A * 10/1993 McCullough ..... F04C 29/025 418/1
5,256,044 A 10/1993 Nieter et al.
5,263,822 A * 11/1993 Fujio ..... F04C 18/0215 418/55.4
5,277,563 A * 1/1994 Wen-Jen ..... F04C 29/0021 418/55.5
5,328,341 A 7/1994 Forni
5,421,709 A 6/1995 Hill et al.
5,449,279 A * 9/1995 Hill ..... F04C 18/023 418/55.5
5,490,769 A * 2/1996 Calhoun ..... F04C 18/023 418/1
5,713,731 A 2/1998 Utter et al.
5,791,883 A * 8/1998 Ban ..... F04C 18/0215 417/410.5
6,359,357 B1 3/2002 Blumenstock
6,616,430 B2 9/2003 Mori et al.
6,692,205 B2 * 2/2004 Moroi ..... F04C 23/008 417/366
6,712,589 B2 * 3/2004 Mori ..... F01C 17/063 417/410.5
6,776,593 B1 8/2004 Cho
6,993,910 B2 * 2/2006 Iwanami ..... F02C 7/36 417/374
7,201,567 B2 * 4/2007 Wiertz ..... F01C 21/10 417/410.5
7,344,367 B2 * 3/2008 Manole ..... F04C 18/321 137/539
8,007,260 B2 8/2011 Yanagisawa
8,058,762 B2 11/2011 Asano
8,179,016 B2 5/2012 Asano
8,323,006 B2 * 12/2012 Schofield ..... F04C 18/0215 417/410.5
8,373,326 B2 2/2013 Enomoto et al.
8,894,388 B2 11/2014 Lee et al.
9,169,841 B2 10/2015 Bonnefoi et al.
9,534,599 B2 1/2017 Rosson et al.
10,215,174 B2 2/2019 Stover et al.
10,280,922 B2 5/2019 Doepker et al.
10,400,770 B2 9/2019 Fullenkamp et al.
10,415,567 B2 9/2019 Doepker et al.
10,465,954 B2 11/2019 Doepker et al.
10,718,330 B2 7/2020 Stover et al.
10,995,754 B2 5/2021 Doepker et al.
2002/0182094 A1 * 12/2002 Mori ..... F04C 18/023 418/55.5
2005/0031465 A1 * 2/2005 Dreiman ..... F04C 18/32 417/356
2005/0201884 A1 * 9/2005 Dreiman ..... F04C 18/321 418/173
2008/0087033 A1 4/2008 Bae et al.
2009/0104060 A1 4/2009 Sato et al.
2010/0164313 A1 7/2010 Langford et al.
2010/0225195 A1 9/2010 Asano et al.
2011/0002797 A1 * 1/2011 Takeuchi ..... F04C 18/023 417/405
2011/0038737 A1 2/2011 Conry et al.
2012/0131945 A1 5/2012 Huang et al.
2012/0171060 A1 * 7/2012 Shin ..... F04C 18/322 417/410.3
2013/0036762 A1 2/2013 Shaffer et al.
2013/0181565 A1 7/2013 Petro et al.
2014/0361651 A1 12/2014 Park et al.
2016/0043602 A1 2/2016 Hosek et al.
2017/0051741 A1 2/2017 Shaffer et al.
2018/0013336 A1 1/2018 Li
2018/0080446 A1 3/2018 Choi et al.
2018/0087509 A1 3/2018 Johnson et al.
2018/0223842 A1 8/2018 Stover et al.
2018/0223848 A1 8/2018 Doepker et al.
2018/0223849 A1 8/2018 Doepker et al.
2018/0224171 A1 8/2018 Doepker et al.
2018/0363654 A1 12/2018 Doepker et al.
2019/0178247 A1 6/2019 Yamashita et al.
2020/0025199 A1 1/2020 Wilson et al.

FOREIGN PATENT DOCUMENTS

CN 103807166 A 5/2014
CN 105971880 A 9/2016
EP 0534891 A1 3/1993
JP S62210279 A 9/1987
JP H02140477 A 5/1990
JP H02207190 A 8/1990
JP H06213232 A 8/1994
JP H0712076 A 1/1995
JP 07229481 A * 8/1995
JP H07229481 A 8/1995
JP H07332260 A 12/1995
JP 2004052657 A 2/2004
JP 2012115084 A 6/2012
JP 2012215092 A 11/2012
JP 2015004296 A 1/2015
JP 2015124653 A 7/2015
KR 1019910001253 1/1991
KR 20110000545 A 1/2011
KR 20120069713 A 6/2012

(56) References Cited

FOREIGN PATENT DOCUMENTS

| | | | |
|---|---|---|---|
| KR | 20150006278 | A | 1/2015 |
| KR | 20160091106 | A | 8/2016 |
| KR | 20180031389 | A | 3/2018 |
| TW | 223674 | B | 5/1994 |
| WO | WO-2018116696 | A1 | 6/2018 |
| WO | WO-2018134739 | A1 | 7/2018 |

OTHER PUBLICATIONS

International Search Report of the ISA regarding International Patent Application No. PCT/US2018/017069, dated Jun. 12, 2018.
Written Opinion of the ISA regarding International Patent Application No. PCT/US2018/017069, dated Jun. 12, 2018.
U.S. Appl. No. 15/425,319, filed Feb. 6, 2017.
U.S. Appl. No. 15/425,374, filed Feb. 6, 2017.
U.S. Appl. No. 15/425,428, filed Feb. 6, 2017.
U.S. Appl. No. 15/205,907, filed Jul. 8, 2016.
Frank, et al., NASA Tech Briefs, Ring Motors—Design Flexibility for Innovative Configurations, Sep. 1, 2014.
McMullen, et al., Combination Radial-Axial Magnetic Bearing, Seventh International Symp. On Magnetic Bearings, Aug. 23-25, 2000.
"Design of Electric Machines: Axial Flux Machines," Electric Energy Magazine No. 4, Jan.-Jun. 2013, 23 pages.
Mahmoudi, Rahim and Hew, "Axial-flux permanent-magnet machine modeling, design, simulation and analysis," Scientific Research and Essays vol. 6 (12), Jun. 18, 2011, pp. 2525-2549.
U.S. Appl. No. 15/877,870, filed Jan. 23, 2018, Roy J. Doepker et al.
Office Action regarding U.S. Appl. No. 16/284,653, dated Jul. 29, 2019.
Notice of Allowance regarding U.S. Appl. No. 15/425,319, dated Aug. 7, 2019.
Office Action regarding U.S. Appl. No. 15/205,907, dated Aug. 9, 2019.
Office Action regarding Chinese Patent Application No. 201810116198.8, dated Aug. 26, 2019. Translation provided by Unitalen Attorneys at Law.
Office Action regarding Chinese Patent Application No. 201810118025.X, dated Aug. 28, 2019. Translation provided by Unitalen Attorneys at Law.
Office Action regarding Indian Patent Application No. 201824003471, dated Sep. 11, 2019.
Office Action regarding Chinese Patent Application No. 201810119178.6, dated Oct. 18, 2019. Translation provided by Unitalen Attorneys at Law.
Hinckley, Mark, "New Levels of Performance with Magnetic Bearings." Design World, https://www.designworldonline.com/new-levels-of-performance-with-magnetic-bearings/ (Oct. 8, 2010).
Office Action regarding Chinese Patent Application No. 201810118025.X, dated Feb. 25, 2020. Translation provided by Unitalen Attorneys at Law.
Notice of Allowance regarding U.S. Appl. No. 16/284,653, dated Mar. 12, 2020.
Office Action regarding U.S. Appl. No. 15/877,870, dated Apr. 13, 2020.
Hasegawa, Hiroshi et al., "Dynamic Analysis of a Co-Rotating Scroll Compressor." International Compressor Engineering Conference, Paper 1313, pp. 643-648 (1998).
Office Action regarding Mexican Patent Application No. MX/a/2017/008998, dated Oct. 1, 2019. Translation provided by Panamericana de Patentes y Marcas, S.C.
Office Action regarding Chinese Patent Application No. 201880016172.4, dated Jul. 1, 2020. Translation provided by Unitalen Attorneys at Law.
Office Action regarding Chinese Patent Application No. 201710551365.7, dated Jul. 3, 2020. Summary translation provided by Zhongzi Law Office.
U.S. Appl. No. 17/097,478, filed Nov. 13, 2020, Kirill M. Ignatiev et al.
Office Action regarding European Patent Application No. 18155362.9, dated Oct. 2, 2020.
Office Action regarding European Patent Application No. 18155363.7, dated Oct. 7, 2020.
Ex Parte Quayle Action regarding U.S. Appl. No. 15/877,870, dated Oct. 19, 2020.
Office Action regarding Korean Patent Application No. 10-2019-7023591, dated Oct. 19, 2020. Translation provided by Y.S. Chang & Associates.
Notice of Allowance regarding U.S. Appl. No. 15/877,870, dated Jan. 28, 2021.
Office Action regarding Chinese Patent Application No. 201880016172.4, dated Feb. 26, 2021. Translation provided by Unitalen Attorneys at Law.
International Search Report regarding International Application No. PCT/US2020/060527, dated Mar. 5, 2021.
Written Opinion of the International Searching Authority regarding International Application No. PCT/US2020/060527, dated Mar. 5, 2021.
Office Action regarding European Application No. 18155358.7 dated Oct. 6, 2020.
Office Action regarding Chinese Patent Application No. 201810116198.8, dated Feb. 26, 2019. Translation provided by Unitalen Attorneys at Law.
Office Action regarding Korean Patent Application No. 10-2018-0013620, dated Feb. 26, 2019. Translation provided by KS KORYO International IP Law Firm.
Office Action regarding Chinese Patent Application No. 201810119087.2, dated Feb. 27, 2019. Translation provided by Unitalen Attorneys at Law.
Office Action regarding Chinese Patent Application No. 201810118025.X, dated Mar. 4, 2019. Translation provided by Unitalen Attorneys at Law.
Office Action regarding Korean Patent Application No. 10-2018-0013622, dated Mar. 20, 2019. Translation provided by KS KORYO International IP Law Firm.
Office Action regarding Chinese Patent Application No. 201810119178.6, dated Mar. 21, 2019. Translation provided by Unitalen Attorneys at Law.
Office Action regarding Korean Patent Application No. 10-2018-0013621, dated Mar. 25, 2019. Translation provided by KS KORYO International IP Law Firm.
Office Action regarding U.S. Appl. No. 16/114,912, dated Mar. 28, 2019.
Office Action regarding U.S. Appl. No. 15/425,319, dated Apr. 1, 2019.
U.S. Appl. No. 16/114,912, filed Aug. 28, 2018, Roy J. Doepker et al.
Election/Restriction Requirement regarding U.S. Appl. No. 15/425,428, dated Aug. 8, 2018.
Office Action regarding U.S. Appl. No. 15/425,428, dated Nov. 1, 2018.
Notice of Allowance regarding U.S. Appl. No. 15/425,374, dated Nov. 7, 2018.
U.S. Appl. No. 16/284,653, filed Feb. 25, 2019, Robert C. Stover et al.
Office Action regarding U.S. Appl. No. 16/114,912, dated Dec. 3, 2018.
Election Requirement regarding U.S. Appl. No. 15/425,319, dated Jan. 10, 2019.
Notice of Allowance regarding U.S. Appl. No. 15/425,428, dated Feb. 15, 2019.
Office Action regarding Korean Patent Application No. 10-2018-0013623, dated Feb. 18, 2019. Translation provided by KS KORYO International IP Law Firm.
Partial Search Report regarding European Patent Application No. 18155358.7, dated Jun. 27, 2018.

(56) References Cited

OTHER PUBLICATIONS

Search Report regarding European Patent Application No. 18155363.7, dated Jul. 2, 2018.
Search Report regarding European Patent Application No. 18155362.9, dated Jul. 2, 2018.
Office Action regarding U.S. Appl. No. 15/425,374, dated Jul. 27, 2018.

* cited by examiner

CO-ROTATING COMPRESSOR

FIELD

The present disclosure relates to a co-rotating compressor.

BACKGROUND

This section provides background information related to the present disclosure and is not necessarily prior art.

A compressor may be used in a refrigeration, heat pump, HVAC, or chiller system (generically, "climate control system") to circulate a working fluid therethrough. The compressor may be one of a variety of compressor types. For example, the compressor may be a scroll compressor, a rotary-vane compressor, a reciprocating compressor, a centrifugal compressor, or an axial compressor. Some compressors include a motor assembly that rotates a driveshaft. In this regard, compressors often utilize a motor assembly that includes a stator surrounding a central rotor that is coupled to the driveshaft below the compression mechanism. Regardless of the exact type of compressor employed, consistent and reliable operation of the compressor is desirable to effectively and efficiently circulate the working fluid through the climate control system. The present disclosure provides an improved compressor having a motor assembly that efficiently and effectively drives the compression mechanism while reducing the overall size of the compressor.

SUMMARY

This section provides a general summary of the disclosure, and is not a comprehensive disclosure of its full scope or all of its features.

The present disclosure provides a compressor that may include a first scroll member, a second scroll member, a first bearing housing, a second bearing housing and a motor assembly. The first scroll member includes a first end plate and a first spiral wrap extending from the first end plate. The second scroll member includes a second end plate and a second spiral wrap extending from the second end plate and intermeshed with the first spiral wrap to define compression pockets therebetween. The first bearing housing may support the first scroll member for rotation about a first rotational axis. The second bearing housing may support the second scroll member for rotation about a second rotational axis that is parallel to the first rotational axis and offset from the first rotational axis. The motor assembly may be disposed axially between the first and second bearing housings and may include a rotor attached to the first scroll member. The rotor may surround the first end plate and the second end plate.

In some configurations, the rotor includes a radially extending portion that extends radially relative to the first rotational axis and an axially extending portion that extends parallel to the first rotational axis.

In some configurations, the axially extending portion engages the first end plate and surrounds the second scroll member.

In some configurations, the compressor includes a seal engaging the rotor and the second scroll member. The radially extending portion may engage the seal. The second end plate may be disposed between the first end plate and the radially extending portion in a direction extending along the first rotational axis.

In some configurations, the radially extending portion includes an annular recess that encircles the first and second rotational axes. The seal may be at least partially disposed within the annular recess.

In some configurations, the annular recess is in fluid communication with a passage formed in the second end plate. The passage may be in fluid communication with intermediate-pressure fluid in one of the compression pockets. The intermediate-pressure fluid is at a pressure greater than a suction pressure at which the fluid enters the compressor and less than a discharge pressure at which the fluid exits the compressor. The intermediate-pressure fluid in the recess biases the second end plate in an axial direction toward the first end plate and away from the radially extending portion of the rotor.

In some configurations, the compressor includes a shell (e.g., a shell assembly) cooperating with the first bearing housing to define a discharge chamber and a suction chamber. The discharge chamber receives fluid discharged from a radially inner one the compression pockets. The suction chamber provides fluid to a radially outer one of the compression pockets. The first bearing housing may define a high-side lubricant sump disposed within the discharge chamber.

In some configurations, the first bearing housing includes an axially extending lubricant passage and a first radially extending lubricant passage in fluid communication with the high-side lubricant sump. The second bearing housing may include a second radially extending lubricant passage in fluid communication with the axially extending lubricant passage. The first radially extending lubricant passage may provide lubricant to a first bearing rotatably supporting the first scroll member. The second radially extending lubricant passage may provide lubricant to a second bearing rotatably supporting the second scroll member.

In some configurations, the compressor includes a valve mounted to the first bearing housing and controlling fluid flow through the axially extending lubricant passage.

In some configurations, the compressor includes an Oldham coupling engaging the second scroll member and either the first scroll member or the rotor.

In some configurations, the first scroll member includes an axially extending suction passage and one or more radially extending suction passages. The axially extending suction passage may extend along the first rotational axis through a first hub of the first scroll member. The radially extending suction passage is in fluid communication with the axially extending suction passage and extends radially outward through the first end plate of the first scroll member and provides working fluid to a radially outermost compression pocket defined by the first and second spiral wraps.

In some configurations, the first bearing housing includes a radially extending suction passage providing fluid communication between a suction inlet of a shell of the compressor and a suction inlet opening in the first end plate.

In some configurations, the first bearing housing includes a flange portion and an annular wall. The annular wall may surround the first end plate. The flange portion may be disposed at an axial end of the annular wall and may include a central hub that rotatably supports the first scroll member. The radially extending suction passage may extend radially through the flange portion and may include a first end disposed radially outward relative to the annular wall and a second end disposed radially inward of the annular wall.

In some configurations, the annular wall defines a suction baffle that directs working fluid from the suction inlet of the shell to the radially extending suction passage. The first end of the radially extending suction passage may be disposed between first and second walls of the suction baffle.

In some configurations, the second end of the radially extending suction passage is disposed radially inward relative to an annular shroud mounted to the first end plate.

The present disclosure also provides a compressor that may include a first scroll member, a second scroll member, a first bearing housing, a second bearing housing, a motor assembly, and a seal. The first scroll member includes a first end plate and a first spiral wrap extending from the first end plate. The second scroll member includes a second end plate and a second spiral wrap extending from the second end plate and intermeshed with the first spiral wrap to define compression pockets therebetween. The first bearing housing may support the first scroll member for rotation about a first rotational axis. The second bearing housing may support the second scroll member for rotation about a second rotational axis that is parallel to the first rotational axis and offset from the first rotational axis. The motor assembly may include a rotor attached to the first scroll member. The seal may engage the rotor and the second scroll member.

In some configurations, the rotor includes a radially extending portion that extends radially relative to the first rotational axis and an axially extending portion that extends parallel to the first rotational axis.

In some configurations, the axially extending portion engages the first end plate and surrounds the second scroll member.

In some configurations, the radially extending portion engages the seal. The second end plate may be disposed between the first end plate and the radially extending portion in a direction extending along the first rotational axis.

In some configurations, the radially extending portion includes an annular recess that encircles the first and second rotational axes. The seal may be at least partially disposed within the annular recess.

In some configurations, the annular recess is in fluid communication with a passage formed in the second end plate. The passage may be in fluid communication with intermediate-pressure fluid in one of the compression pockets. The intermediate-pressure fluid is at a pressure greater than a suction pressure at which the fluid enters the compressor and less than a discharge pressure at which the fluid exits the compressor. The intermediate-pressure fluid in the recess biases the second end plate in an axial direction toward the first end plate and away from the radially extending portion of the rotor.

In some configurations, the compressor includes a shell (e.g., a shell assembly) cooperating with the first bearing housing to define a discharge chamber and a suction chamber. The discharge chamber receives fluid discharged from a radially inner one the compression pockets. The suction chamber provides fluid to a radially outer one of the compression pockets. The first bearing housing may define a high-side lubricant sump disposed within the discharge chamber.

In some configurations, the first bearing housing includes an axially extending lubricant passage and a first radially extending lubricant passage in fluid communication with the high-side lubricant sump. The second bearing housing may include a second radially extending lubricant passage in fluid communication with the axially extending lubricant passage. The first radially extending lubricant passage may provide lubricant to a first bearing rotatably supporting the first scroll member. The second radially extending lubricant passage may provide lubricant to a second bearing rotatably supporting the second scroll member.

In some configurations, the compressor includes a valve mounted to the first bearing housing and controlling fluid flow through the axially extending lubricant passage.

In some configurations, the compressor includes an Oldham coupling engaging the second scroll member and either the first scroll member or the rotor.

The present disclosure also provides a compressor that may include a shell (e.g., a shell assembly), a first compression member, a second compression member, and a motor assembly. The first compression member is disposed within the shell and rotates relative to the shell about a first rotational axis. The second compression member is disposed within the shell and cooperates with the first compression member to define compression pockets therebetween. The motor assembly is disposed within the shell and is drivingly coupled to the first compression member. The motor assembly may include a rotor attached to the first compression member and surrounding at least a portion of the first compression member and at least a portion of the second compression member. The rotor may include an axially extending portion and a radially extending portion. The axially extending portion extends parallel to the first rotational axis and may engage the first compression member. The radially extending portion may extend radially inward from an axial end of the axially extending portion.

In some configurations, the compressor includes a first bearing housing and a second bearing housing. The first bearing housing may support the first compression member for rotation about the first rotational axis. The second bearing housing may support the second compression member for rotation about a second rotational axis that is parallel to the first rotational axis and offset from the first rotational axis.

In some configurations, the compressor includes a seal engaging the radially extending portion and the second compression member. The radially extending portion may engage the seal. The radially extending portion may include an annular recess that encircles the first rotational axis. The seal may be at least partially disposed within the annular recess.

In some configurations, the first and second compression members are first and second scroll members each having an end plate and a spiral wrap extending from the end plate.

In some configurations, the second end plate is disposed between the first end plate and the radially extending portion in a direction extending along the first rotational axis.

In some configurations, the compressor includes a first bearing housing supporting the first scroll member for rotation about a first rotational axis. The first bearing housing may include a radially extending suction passage providing fluid communication between a suction inlet of the shell and a suction inlet opening in the end plate of the first scroll member.

In some configurations, the first bearing housing includes a flange portion and an annular wall. The annular wall may surround the end plate of the first scroll member. The flange portion may be disposed at an axial end of the annular wall and may include a central hub that rotatably supports the first scroll member. The radially extending suction passage may extend radially through the flange portion and may include a first end disposed radially outward relative to the annular wall and a second end disposed radially inward of the annular wall and radially inward relative to an annular shroud mounted to the end plate of the first scroll member.

In some configurations, the annular wall defines a suction baffle that directs working fluid from the suction inlet of the shell to the radially extending suction passage. The first end of the radially extending suction passage may be disposed between first and second walls of the suction baffle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
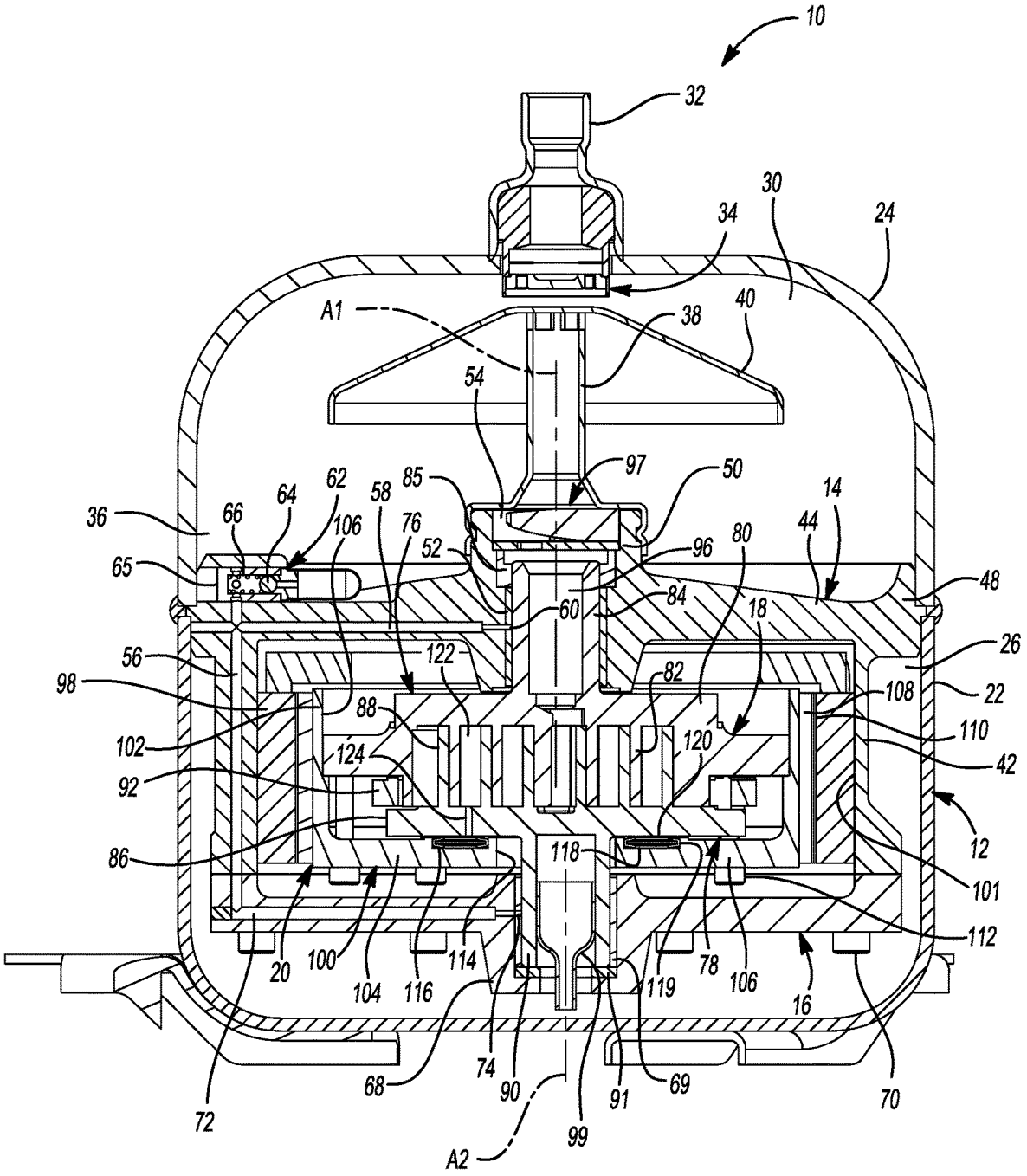
FIG. 1 is a cross-sectional view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
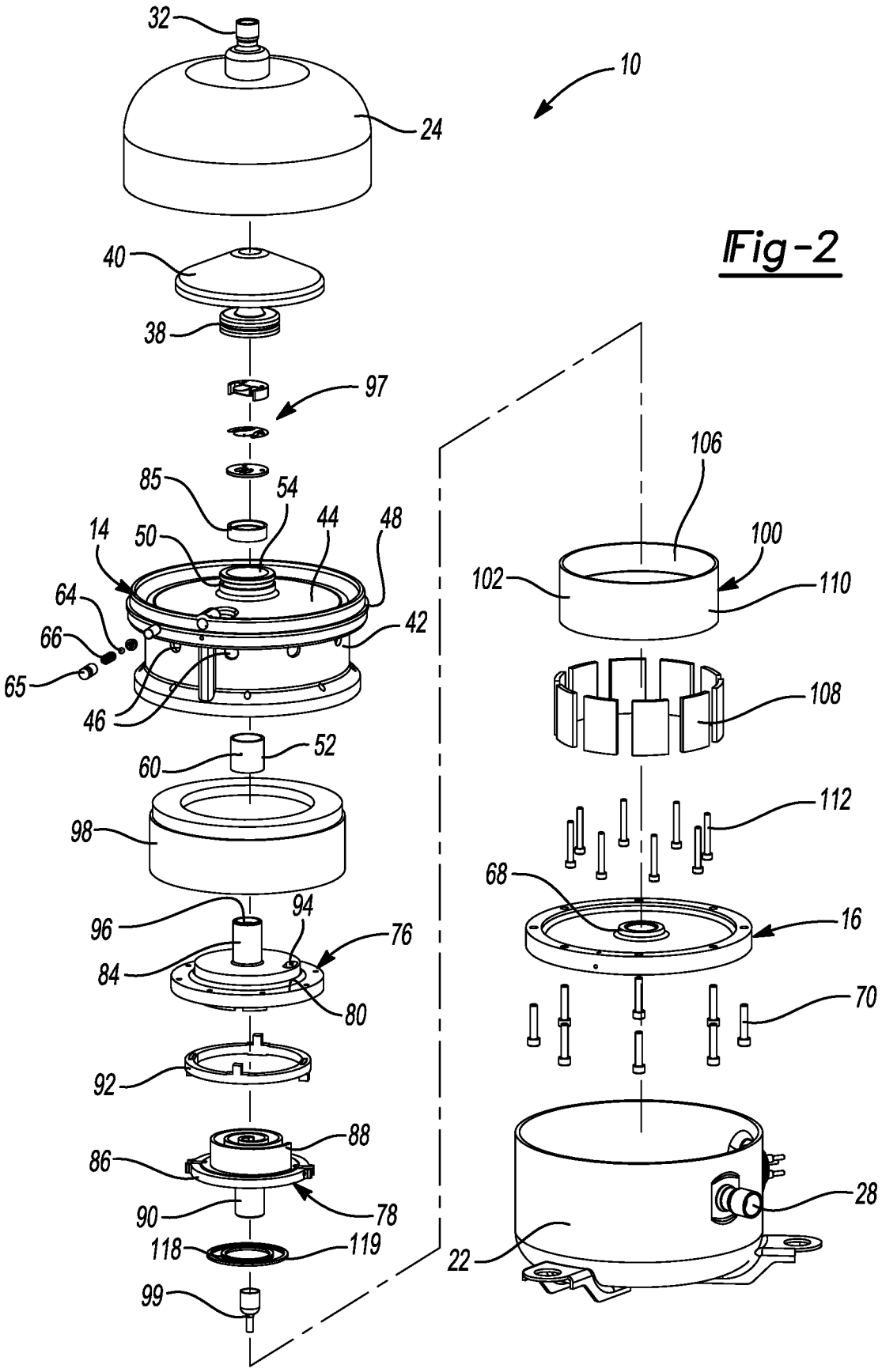
FIG. 2 is an exploded view of the compressor of FIG. 1.

With reference to FIGS. 1 and 2, a compressor 10 is provided that may include a shell assembly 12, a first bearing housing 14, a second bearing housing 16, a compression mechanism 18, and a motor assembly 20. The shell assembly 12 may include a first shell body 22 and a second shell body 24. The first and second shell bodies 22, 24 may be fixed to each other and to the first bearing housing 14. The first shell body 22 and the first bearing housing 14 may cooperate with each other to define a suction chamber 26 in which the second bearing housing 16, the compression mechanism 18 and the motor assembly 20 may be disposed. A suction inlet fitting 28 (FIG. 2) may engage the first shell body 22 and may be in fluid communication with the suction chamber 26. Suction-pressure working fluid (i.e., low-pressure working fluid) may enter the suction chamber 26 through the suction inlet fitting 28 and may be drawn into the compression mechanism 18 for compression therein. The compressor 10 may be a low-side compressor (i.e., the motor assembly 20 and at least a majority of the compression mechanism 18 are disposed in the suction chamber 26).

The second shell body 24 and the first bearing housing 14 may cooperate with each other to define a discharge chamber 30. The first bearing housing 14 may sealingly engage the first and second shell bodies 22, 24 to separate the discharge chamber 30 from the suction chamber 26. A discharge outlet fitting 32 may engage the second shell body 24 and may be in fluid communication with the discharge chamber 30. Discharge-pressure working fluid (i.e., working fluid at a higher pressure than suction pressure) may enter the discharge chamber 30 from the compression mechanism 18 and may exit the compressor 10 through the discharge outlet fitting 32. In some configurations, a discharge valve 34 may be disposed within the discharge outlet fitting 32. The discharge valve 34 may be a check valve that allows fluid to exit the discharge chamber 30 through the discharge outlet fitting 32 and prevents fluid from entering the discharge chamber 30 through the discharge outlet fitting 32.

In some configurations, a high-side lubricant sump 36 may be disposed in the discharge chamber 30. That is, the second shell body 24 and the first bearing housing 14 may cooperate with each other to define the lubricant sump 36. A mixture of discharge-pressure working fluid and lubricant may be discharged from the compression mechanism 18 through a discharge pipe 38 mounted to the first bearing housing 14. The discharge pipe 38 may direct the mixture of discharge-pressure working fluid and lubricant to a lubricant separator 40 that separates the lubricant from the discharge-pressure working fluid. The separated lubricant may fall from the lubricant separator 40 into the lubricant sump 36 and the separated discharge-pressure working fluid may flow toward the discharge outlet fitting 32.

The first bearing housing 14 may include a generally cylindrical annular wall 42 and a radially extending flange portion 44 disposed at an axial end of the annular wall 42. The annular wall 42 may include one or more openings or apertures 46 (FIG. 2) through which suction-pressure working fluid in the suction chamber 26 can flow to the compression mechanism 18. The flange portion 44 may include an outer rim 48 that is welded to (or otherwise fixedly engages) the first and second shell bodies 22, 24. The flange portion 44 may include a central hub 50 that receives a first bearing 52. The discharge pipe 38 may be mounted to the central hub 50. The central hub 50 may define a discharge passage 54 through which discharge-pressure working fluid flows from the compression mechanism 18 to the discharge pipe 38.

The first bearing housing 14 may include an axially extending lubricant passage 56 that extends through the annular wall 42 and the flange portion 44 and is in fluid communication with the lubricant sump 36. The flange portion 44 may also include a first radially extending lubricant passage 58 that is in fluid communication with the axially extending lubricant passage 56 and an aperture 60 that extends through the first bearing 52. A valve assembly 62 may be mounted to the flange portion 44 and selectively allows and prevents lubricant to flow from the lubricant sump 36 to the axially extending lubricant passage 56. Lubricant may flow from the axially extending lubricant passage 56 to the first radially extending lubricant passage 58 and the aperture 60. The valve assembly 62 may include a valve member (e.g., a ball) 64 movable within a valve housing 65 between open and closed positions to allow and prevent lubricant to flow from the lubricant sump 36 to the axially extending lubricant passage 56. Fluid pressure from the lubricant and working fluid in the discharge chamber 30 may urge the valve member 64 toward the open position. A spring 66 may bias the valve member 64 toward the closed position.

The second bearing housing 16 may be a generally disk-shaped member having a central hub 68 that receives a second bearing 69. The second bearing housing 16 may be fixedly attached to an axial end of the annular wall 42 of the first bearing housing 14 via a plurality of fasteners 70, for example. The second bearing housing 16 may include a second radially extending lubricant passage 72 that is in fluid communication with the axially extending lubricant passage 56 in the first bearing housing 14 and an aperture 74 that extends through the second bearing 69. Lubricant may flow from the axially extending lubricant passage 56 to the second radially extending lubricant passage 72 and the aperture 74.

The compression mechanism 18 may include a first compression member and a second compression member that cooperate to define fluid pockets (i.e., compression pockets) therebetween. For example, the compression mechanism 18 may be a co-rotating scroll compression mechanism in which the first compression member is a first scroll member (i.e., a driven scroll member) 76 and the second compression member is a second scroll member (i.e., an idler scroll member) 78. In other configurations, the compression mechanism 18 could be another type of compression mechanism, such as an orbiting scroll compression mechanism, a rotary compression mechanism, a screw compression mechanism, a Wankel compression mechanism or a reciprocating compression mechanism, for example.

The first scroll member 76 may include a first end plate 80, a first spiral wrap 82 extending from one side of the first end plate 80, and a first hub 84 extending from the opposite side of the first end plate 80. The second scroll member 78 may include a second end plate 86, a second spiral wrap 88 extending from one side of the second end plate 86, and a second hub 90 extending from the opposite side of the second end plate 86. The first hub 84 of the first scroll member 76 is received within the central hub 50 of the first bearing housing 14 and is supported by the first bearing housing 14 and the first bearing 52 for rotation about a first rotational axis A1 relative to the first and second bearing housings 14, 16. A seal 85 is disposed within the central hub 50 and sealing engages the central hub 50 and the first hub 84. The second hub 90 of the second scroll member 78 is received within the central hub 68 of the second bearing housing 16 and is supported by the second bearing housing 16 and the second bearing 69 for rotation about a second rotational axis A2 relative to the first and second bearing housings 14, 16. The second rotational axis A2 is parallel to first rotational axis A1 and is offset from the first rotational axis A1. A thrust bearing 91 may be disposed within the central hub 68 of the second bearing housing 16 and may support an axial end of the second hub 90 of the second scroll member 78.

An Oldham coupling 92 may be keyed to the first and second end plates 80, 86. In some configurations, the Oldham coupling 92 could be keyed to the second end plate 86 and a rotor 100 of the motor assembly 20. The first and second spiral wraps 82, 88 are intermeshed with each other and cooperate to form a plurality of fluid pockets (i.e., compression pockets) therebetween. Rotation of the first scroll member 76 about the first rotational axis A1 and rotation of the second scroll member 78 about the second rotational axis A2 causes the fluid pockets to decrease in size as they move from a radially outer position to a radially inner position, thereby compressing the working fluid therein from the suction pressure to the discharge pressure.

The first end plate 80 may include a suction inlet opening 94 (FIG. 2) providing fluid communication between the suction chamber 26 and a radially outermost one of the fluid pockets. The first scroll member 76 also includes a discharge passage 96 that extends through the first end plate 80 and the first hub 84 and provides fluid communication between a radially innermost one of the fluid pockets and the discharge chamber 30 (e.g., via the discharge passage 54 and the discharge pipe 38). A discharge valve assembly 97 may be disposed within the discharge passage 54. The discharge valve assembly 97 allows working fluid to be discharged from the compression mechanism 18 through the discharge passage 96 into the discharge chamber 30 and prevents working fluid from the discharge chamber 30 from flowing back into to the discharge passage 96.

The second hub 90 of the second scroll member 78 may house a scavenging tube 99 that can scavenge oil from the bottom of the first shell body 22 during operation of the compressor 10. That is, oil on the bottom of the first shell body 22 may be drawn up through the scavenging tube 99 and may be routed to one or more moving parts of the compressor 10 via one or more lubricant passages. In some configurations, the second scroll member 78 may include one or more oil injection passages (not shown) through which oil from the scavenging tube 99 can be injected into one of the compression pockets.

The motor assembly 20 may be a ring-motor and may include a composite stator 98 and a rotor 100. The stator 98 may be an annular member fixed to an inner diametrical surface 101 of the annular wall 42 of the first bearing housing 14. The stator 98 may surround the first and second end plates 80, 86 and the first and second spiral wraps 82, 88.

The rotor 100 may be disposed radially inside of the stator 98 and is rotatable relative to the stator 98. The rotor 100 may include an annular axially extending portion 102 that extends parallel to the first rotational axis A1 and a radially extending portion 104 that extends radially inward (i.e., perpendicular to the first rotational axis A1) from an axial end of the axially extending portion 102. The axially extending portion 102 may surround the first and second end plates 80, 86 and the first and second spiral wraps 82, 88. An inner diametrical surface 106 of the axially extending portion 102 may engage an outer periphery of the first end plate 80. Magnets 108 may be fixed to an outer diametrical surface 110 of the axially extending portion 102. Fasteners 112 may engage the radially extending portion 104 and the first end plate 80 to rotationally and axially fix the rotor 100 to the first scroll member 76. Therefore, when electrical current is provided to the stator 98, the rotor 100 and the first scroll member 76 rotate about the first rotational axis A1. Such rotation of the first scroll member 76 causes corresponding rotation of the second scroll member 78 about the second rotational axis A2 due to the engagement of the Oldham coupling 92 with the first and second scroll members 76, 78.

The radially extending portion 104 of the rotor 100 may include a central aperture 114 through which the second hub 90 of the second scroll member 78 extends. The radially extending portion 104 may also include an annular recess 116 that surrounds the central aperture 114 and the first and second rotational axes A1, A2. A first annular seal 118 and a second annular seal 119 may be at least partially received in the recess 116 and may sealingly engage the radially extending portion 104 and the second end plate 86. The second annular seal 119 may surround the first annular seal 118. In this manner, the first and second annular seals 118, 119, the second end plate 86 and the radially extending portion 104 cooperate to define an annular chamber 120. The annular chamber 120 may receive intermediate-pressure working fluid (at a pressure greater than suction pressure and less than discharge pressure) from an intermediate fluid pocket 122 via a passage 124 in the second end plate 86. Intermediate-pressure working fluid in the annular chamber 120 biases the second end plate 86 in an axial direction (i.e., a direction parallel to the rotational axes A1, A2) toward the first end plate 80 to improve the seal between tips of the first spiral wrap 82 and the second end plate 86 and the seal between tips of the second spiral wrap 88 and the first end plate 80.

Figure 3:
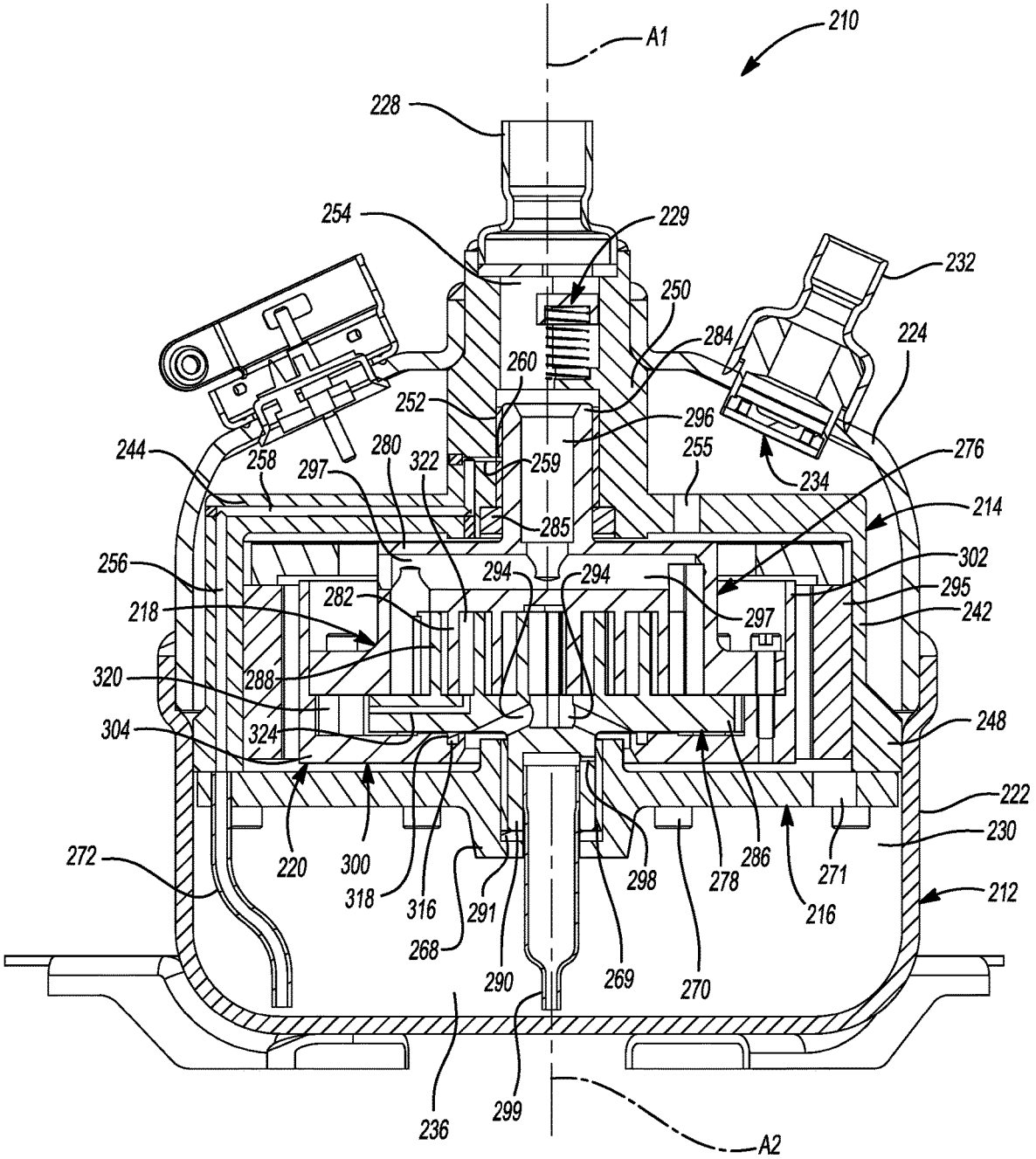
FIG. 3 is a cross-sectional view of another compressor according to the principles of the present disclosure.

With reference to FIG. 3, another compressor 210 is provided that may include a shell assembly 212, a first bearing housing 214, a second bearing housing 216, a compression mechanism 218, and a motor assembly 220. The shell assembly 212 may include a first shell body 222 and a second shell body 224 that is fixed to the first shell body 222 (e.g., via welding, press fit, etc.). The first and second shell bodies 222, 224 may cooperate with each other to define a discharge chamber 230 in which the first and second bearing housings 214, 216, the compression mechanism 218 and the motor assembly 220 may be disposed. Therefore, the compressor 210 is a high-side compressor (i.e., the motor assembly 220 and at least a majority of the compression mechanism 218 are disposed in the discharge chamber 230). A bottom of the first shell body 222 may define a lubricant sump 236 that may contain a volume of lubricant.

A discharge outlet fitting 232 may engage the second shell body 224 and may be in fluid communication with the discharge chamber 230. Discharge-pressure working fluid (i.e., working fluid at a higher pressure than suction pressure) may enter the discharge chamber 230 from the compression mechanism 218 and may exit the compressor through the discharge outlet fitting 232. In some configurations, a discharge valve 234 may be disposed within the discharge outlet fitting 232. The discharge valve 234 may be a check valve that allows fluid to exit the discharge chamber 230 through the discharge outlet fitting 232 and prevents fluid from entering the discharge chamber 230 through the discharge outlet fitting 232.

The first bearing housing 214 may include a generally cylindrical annular wall 242 and a radially extending flange portion 244 disposed at an axial end of the annular wall 242. The annular wall 242 may include an outer rim 248 that may be press-fit into the first shell body 222. The flange portion 244 may include a central hub 250 that receives a first bearing 252. The central hub 250 may define a suction passage 254 through which suction-pressure working fluid can be drawn into the compression mechanism 218. The central hub 250 may extend through an opening in the second shell body 224 and may engage a suction inlet fitting 228. A suction valve assembly 229 (e.g., a check valve) may be disposed within the suction passage 254. The suction valve assembly 229 allows suction-pressure working fluid to flow through the suction passage 254 toward the compression mechanism 218 and prevents the flow of working fluid in the opposite direction.

The first bearing housing 214 may include an axially extending lubricant passage 256 that extends through the annular wall 242 and communicates with the lubricant sump 236 and a first radially extending lubricant passage 258 formed in the flange portion 244. The central hub 250 may include a second lubricant passage 259 that is in fluid communication with the first radially extending lubricant passage 258 and an aperture 260 that extends through the first bearing 252. The flange portion 244 of the first bearing housing 214 may also include a discharge passage 255 through which working fluid discharged from the compression mechanism 218.

The second bearing housing 216 may be a generally disk-shaped member having a central hub 268 that receives a second bearing 269. The second bearing housing 216 may be fixedly attached to an axial end of the annular wall 242 of the first bearing housing 214 via a plurality of fasteners 270, for example. A lubricant conduit 272 may extend through an opening in the second bearing housing 216 and may provide fluid communication between the lubricant sump 236 and the axially extending lubricant passage 256 in the first bearing housing 214. During operation of the compressor 210, a pressure differential between low-pressure gas in the suction passage 254 and high-pressure gas in the discharge chamber 230 forces lubricant from the lubricant sump 236 through the lubricant conduit 272, through the axially extending lubricant passage 256, through the first radially extending lubricant passage 258, through the second lubricant passage 259 and through the aperture 260 in the first bearing 252. From the first bearing 252, lubricant can be drawn into the compression mechanism 218. The second bearing housing 216 may also include a drain passage 271 through which lubricant can drain from the compression mechanism 218 and motor assembly 220 back into the lubricant sump 236.

The compression mechanism 218 may be a co-rotating scroll compression mechanism including a first scroll member (i.e., a driven scroll member) 276 and a second scroll member (i.e., an idler scroll member) 278. The first scroll member 276 may include a first end plate 280, a first spiral wrap 282 extending from one side of the first end plate 280, and a first hub 284 extending from the opposite side of the first end plate 280. The second scroll member 278 may include a second end plate 286, a second spiral wrap 288 extending from one side of the second end plate 286, and a second hub 290 extending from the opposite side of the second end plate 286. The first hub 284 of the first scroll member 276 is received within the central hub 250 of the first bearing housing 214 and is supported by the first bearing housing 214 and the first bearing 252 for rotation about a first rotational axis A1 relative to the first and second bearing housings 214, 216. A seal 285 is disposed within the central hub 250 and sealing engages the central hub 250 and the first hub 284. The second hub 290 of the second scroll member 278 is received within the central hub 268 of the second bearing housing 216 and is supported by the second bearing housing 216 and the second bearing 269 for rotation about a second rotational axis A2 relative to the first and second bearing housings 214, 216. The second rotational axis A2 is parallel to first rotational axis A1 and is offset from the first rotational axis A1. A thrust bearing 291 may be disposed within the central hub 268 of the second bearing housing 216 and may support an axial end of the second hub 290 of the second scroll member 278.

An Oldham coupling (not shown) may be keyed to the first and second end plates 280, 286. The first and second spiral wraps 282, 288 are intermeshed with each other and cooperate to form a plurality of fluid pockets (i.e., compression pockets) therebetween. Rotation of the first scroll member 276 about the first rotational axis A1 and rotation of the second scroll member 278 about the second rotational axis A2 causes the fluid pockets to decrease in size as they move from a radially outer position to a radially inner position, thereby compressing the working fluid therein from the suction pressure to the discharge pressure.

The first scroll member 276 may include an axially extending suction passage 296 that extends through the first hub 284 and into the first end plate 280. The axially extending suction passage 296 may extend axially along the first rotational axis A1 (i.e., the axially extending suction passage 296 may be centered on the first rotational axis A1). Radially extending suction passages 297 formed in the first end plate 280 extend radially outward from the axially extending suction passage 296 and provide fluid communication between the axially extending suction passage 296 and radially outermost fluid pockets. Accordingly, during operation of the compressor 210, suction-pressure working fluid can be drawn into the suction inlet fitting 228, through the suction passage 254 of the first bearing housing 214, through the axially extending suction passage 296, and then through the radially extending suction passages 297 to the radially outermost fluid pockets defined by the spiral wraps 282, 288.

The configuration of the axially extending suction passage 296 and the radially extending suction passages 297 shown in FIG. 3 and described above aids the introduction of the working fluid into the radially outermost fluid pockets. That is, centrifugal force due to rotation of the first scroll member 276 directs the working fluid from the axially extending suction passage 296 radially outward through the radially extending suction passages 297. In other words, in addition to the pressure differential that draws the working fluid through the radially extending suction passages 297 toward the radially outermost fluid pockets, the centrifugal force due to rotation of the first scroll member 276 forces the working fluid through the radially extending suction passages 297 toward the radially outermost fluid pockets. Furthermore, the axially extending suction passage 296 and the radially extending suction passages 297 also shield the working fluid from centrifugal windage losses due to rotational of the scroll members 276, 278. Furthermore, shielding the working fluid from the centrifugal windage can prevent or reduce warming of the working fluid from heat generated by viscous shear and aerodynamic effects.

The second scroll member 278 may include one or more discharge passages 294 that extend through the second end plate 286 and provide fluid communication between a radially innermost one of the fluid pockets and the discharge chamber 230. The second hub 290 of the second scroll member 278 may house a scavenging tube 299 that can scavenge oil from the lubricant sump 236 during operation of the compressor 210. That is, oil on the bottom of the first shell body 22 may flow through an aperture 298 in the second hub 290 to the second bearing 269.

The structure and function of the motor assembly 220 may be similar or identical to that of the motor assembly 20. Therefore, similar features may not be described in detail again. Like the motor assembly 20, the motor assembly 220 may be a ring motor including a composite stator 295 and a rotor 300. The stator 295 may be fixed to the annular wall 242 of the first bearing housing 214 and may surround the first and second end plates 280, 286 and the first and second spiral wraps 282, 288.

The rotor 300 may be disposed radially inside of the stator 295 and is rotatable relative to the stator 295. Like the rotor 100, the rotor 300 may include an annular axially extending portion 302 and a radially extending portion 304. The axially extending portion 302 may surround the first and second end plates 280, 286 and the first and second spiral wraps 282, 288. The axially extending portion 302 may engage an outer periphery of the first end plate 280. When electrical current is provided to the stator 298, the rotor 300 and the first scroll member 276 rotate about the first rotational axis A1. Such rotation of the first scroll member 276 causes corresponding rotation of the second scroll member 278 about the second rotational axis A2, as described above.

The radially extending portion 304 may include an annular recess 316 that surrounds the first and second rotational axes A1, A2. An annular seal 318 may be received in the recess 316 and may sealingly engage the radially extending portion 304 and the second end plate 286. The annular seal 318, the first and second end plates 280, 286 and the radially extending portion 304 cooperate to define an annular chamber 320. The annular chamber 320 may receive intermediate-pressure working fluid (at a pressure greater than suction pressure and less than discharge pressure) from an intermediate fluid pocket 322 via a passage 324 in the second end plate 286. Intermediate-pressure working fluid in the annular chamber 320 biases the second end plate 286 in an axial direction (i.e., a direction parallel to the rotational axes A1, A2) toward the first end plate 280 to improve the seal between tips of the first spiral wrap 282 and the second end plate 286 and the seal between tips of the second spiral wrap 288 and the first end plate 280.

Figure 4:
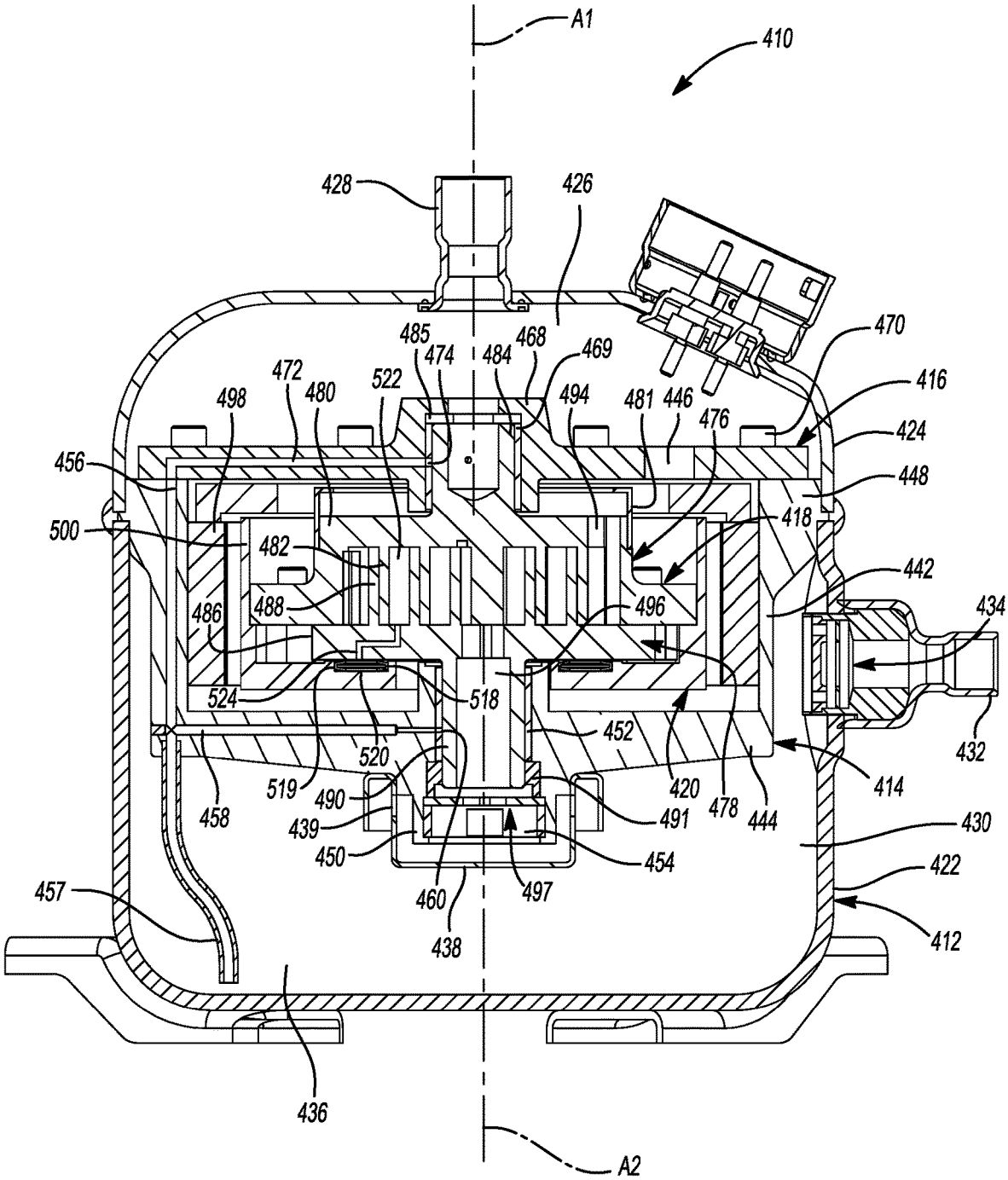
FIG. 4 is a cross-sectional view of yet another compressor according to the principles of the present disclosure.

With reference to FIG. 4 another compressor 410 is provided that may include a shell assembly 412, a first bearing housing 414, a second bearing housing 416, a compression mechanism 418, and a motor assembly 420. The shell assembly 412 may include a first shell body 422 and a second shell body 424. The first and second shell bodies 422, 424 may be fixed to each other and to the first bearing housing 414. The second shell body 424 and the first bearing housing 414 may cooperate with each other to define a suction chamber 426 in which the second bearing housing 416, the compression mechanism 418 and the motor assembly 420 may be disposed. A suction inlet fitting 428 may engage the second shell body 424 and may be in fluid communication with the suction chamber 426. Suction-pressure working fluid (i.e., low-pressure working fluid) may enter the suction chamber 426 through the suction inlet fitting 428 and may be drawn into the compression mechanism 418 for compression therein. The compressor 410 may be a low-side compressor.

The first shell body 422 and the first bearing housing 414 may cooperate with each other to define a discharge chamber 430. The first bearing housing 414 may sealingly engage the first and second shell bodies 422, 424 to separate the discharge chamber 430 from the suction chamber 426. A discharge outlet fitting 432 may engage the first shell body 422 and may be in fluid communication with the discharge chamber 430. Discharge-pressure working fluid (i.e., working fluid at a higher pressure than suction pressure) may enter the discharge chamber 430 from the compression mechanism 418 and may exit the compressor 410 through the discharge outlet fitting 432. In some configurations, a discharge valve 434 may be disposed within the discharge outlet fitting 432. The discharge valve 434 may be a check valve that allows fluid to exit the discharge chamber 430 through the discharge outlet fitting 432 and prevents fluid from entering the discharge chamber 430 through the discharge outlet fitting 432. The first shell body 422 may define a high-side lubricant sump 436 disposed in the discharge chamber 430.

The first bearing housing 414 may include a generally cylindrical annular wall 442 and a radially extending flange portion 444 disposed at an axial end of the annular wall 442. The annular wall 442 may include an outer rim 448 that is welded to (or otherwise fixedly engages) the first and second shell bodies 22, 24. The flange portion 444 may include a central hub 450 that receives a first bearing 452. An oil separator (e.g., an annular shroud) 438 may be mounted to the central hub 450. The central hub 450 may define a discharge passage 454 through which discharge-pressure working fluid flows from the compression mechanism 418 to the oil separator 438. From the oil separator 438, the discharge-pressure working fluid flows into the discharge chamber 430.

The first bearing housing 414 may include an axially extending lubricant passage 456 that extends through the annular wall 442 and the flange portion 444 and is in fluid communication with the lubricant sump 436 via a lubricant conduit 457. The flange portion 444 may also include a first radially extending lubricant passage 458 that is in fluid communication with the axially extending lubricant passage 456 and an aperture 460 that extends through the first bearing 452.

The second bearing housing 416 may be a generally disk-shaped member having a central hub 468 that receives a second bearing 469. The second bearing housing 416 may be fixedly attached to an axial end of the annular wall 442 of the first bearing housing 414 via a plurality of fasteners 470, for example. The second bearing housing 416 may include a second radially extending lubricant passage 472 that is in fluid communication with the axially extending lubricant passage 456 in the first bearing housing 414 and an aperture 474 that extends through the second bearing 469. Lubricant may flow from the axially extending lubricant passage 456 to the second radially extending lubricant passage 472 and the aperture 474. The second bearing housing 416 may include one or more openings or apertures 446 through which suction-pressure working fluid in the suction chamber 426 can flow to the compression mechanism 418.

The compression mechanism 418 may be a co-rotating scroll compression mechanism including a first scroll member (i.e., a driven scroll member) 476 and a second scroll member (i.e., an idler scroll member) 478. The first scroll member 476 may include a first end plate 480, a first spiral wrap 482 extending from one side of the first end plate 480, and a first hub 484 extending from the opposite side of the first end plate 480. The second scroll member 478 may include a second end plate 486, a second spiral wrap 488 extending from one side of the second end plate 486, and a second hub 490 extending from the opposite side of the second end plate 486. The first hub 484 of the first scroll member 476 is received within the central hub 468 of the second bearing housing 416 and is supported by the second bearing housing 416 and the second bearing 469 for rotation about a first rotational axis A1 relative to the first and second bearing housings 414, 416. A thrust bearing 485 is disposed within the central hub 468.

The second hub 490 of the second scroll member 478 is received within the central hub 450 of the first bearing housing 414 and is supported by the first bearing housing 414 and the first bearing 452 for rotation about a second rotational axis A2 relative to the first and second bearing housings 414, 416. The second rotational axis A2 is parallel to first rotational axis A1 and is offset from the first rotational axis A1. A seal 491 may be disposed within the central hub 450 of the first bearing housing 414 and may sealingly engage the central hub 450 and the second hub 490 of the second scroll member 478.

An Oldham coupling may be keyed to the first and second end plates 480, 486. The first and second spiral wraps 482, 488 are intermeshed with each other and cooperate to form a plurality of fluid pockets (i.e., compression pockets) therebetween. Rotation of the first scroll member 476 about the first rotational axis A1 and rotation of the second scroll member 478 about the second rotational axis A2 causes the fluid pockets to decrease in size as they move from a radially outer position to a radially inner position, thereby compressing the working fluid therein from the suction pressure to the discharge pressure.

The first end plate 480 may include a suction inlet opening 494 providing fluid communication between the suction chamber 426 and a radially outermost one of the fluid pockets. The first end plate 480 may also include an annular shroud 481 extending axially therefrom. During operation of the compressor 410, lubricant supplied to the second bearing 469 may drip down onto the first end plate 480 and may move radially outward along the first end plate 480 due to centrifugal force. The annular shroud 481 may channel this lubricant on the first end plate 480 into the suction inlet opening 494 to lubricate the first and second scroll members 476, 478.

The second scroll member 478 may include a discharge passage 496 that extends through the second end plate 486 and the second hub 490 and provides fluid communication between a radially innermost one of the fluid pockets and the discharge chamber 430. A discharge valve assembly 497 may be disposed within the discharge passage 454. The discharge valve assembly 497 allows working fluid to be discharged from the compression mechanism 418 through the discharge passage 496 into the discharge chamber 430 and prevents working fluid from the discharge chamber 430 from flowing back into to the discharge passage 496.

Working fluid discharged from the compression mechanism 418 may flow from the discharge passage 454 through one or more openings 439 in the oil separator 438 and into the discharge chamber 430 before exiting the compressor through the discharge outlet fitting 432. Lubricant mixed with the working fluid that is discharged from the compression mechanism 418 may separate from the working fluid when the mixture contacts walls of the oil separator 438. The separated lubricant may fall from the oil separator 438 into the lubricant sump 436.

The structure and function of the motor assembly 420 may be similar or identical to that of the motor assembly 20 described above. Therefore, similar features may not be described again in detail. Briefly, the motor assembly 420 may include a stator 498 fixed to the annular wall 442 of the first bearing housing 414 and a rotor 500 may be disposed radially inside of the stator 498 and attached to the first scroll member 476. First and second annular seals 518, 519 (similar or identical to annular seals 118, 119), the second end plate 486 and a radially extending portion 504 of the rotor 500 cooperate to define an annular chamber 520 that receives intermediate-pressure working fluid from an intermediate fluid pocket 522 via a passage 524 in the second end plate 486. Intermediate-pressure working fluid in the annular chamber 520 biases the second end plate 486 in an axial direction toward the first end plate 480 to improve the seal between tips of the first spiral wrap 482 and the second end plate 486 and the seal between tips of the second spiral wrap 488 and the first end plate 480, as described above.

Figure 5:
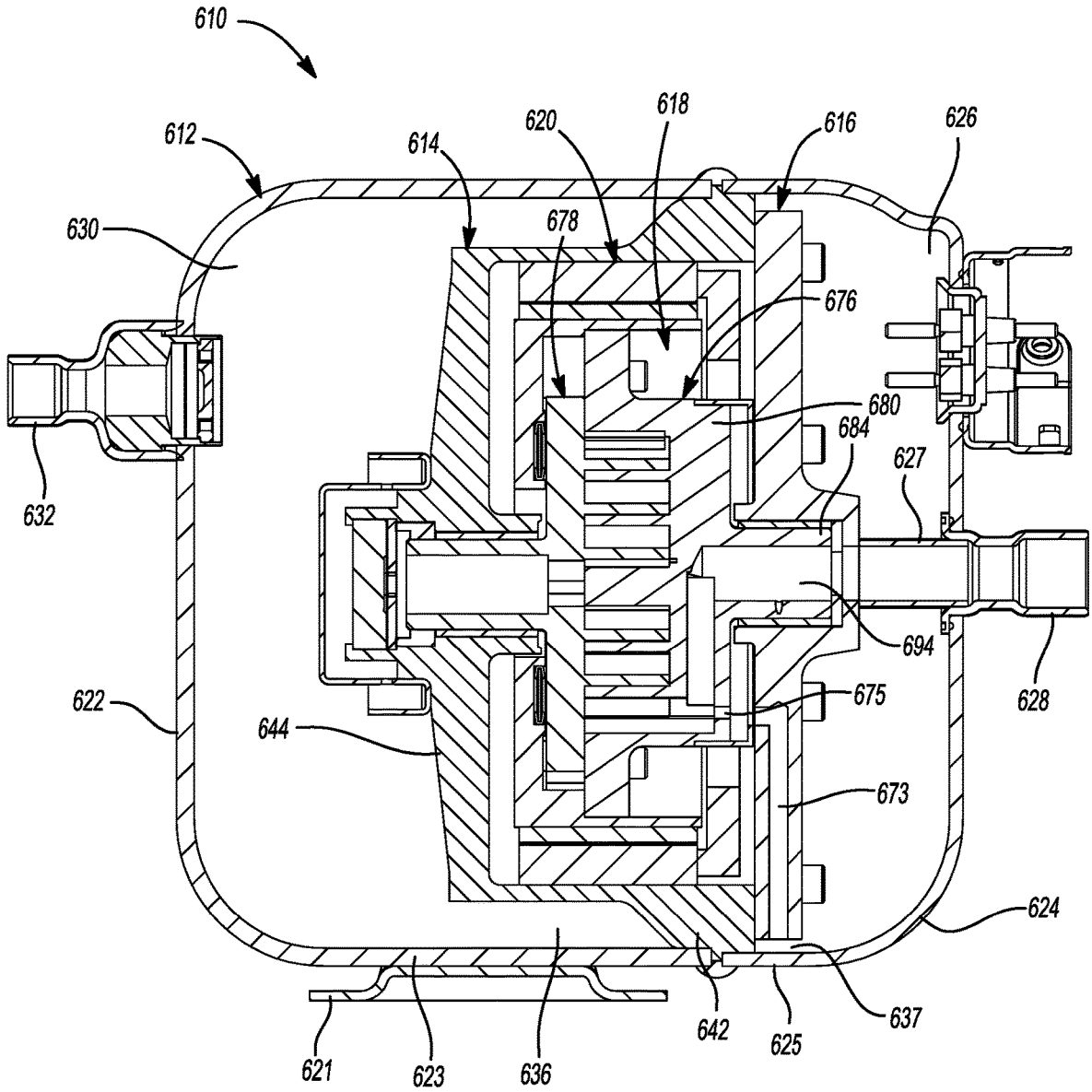
FIG. 5 is a cross-sectional view of yet another compressor according to the principles of the present disclosure.
Figure 6:
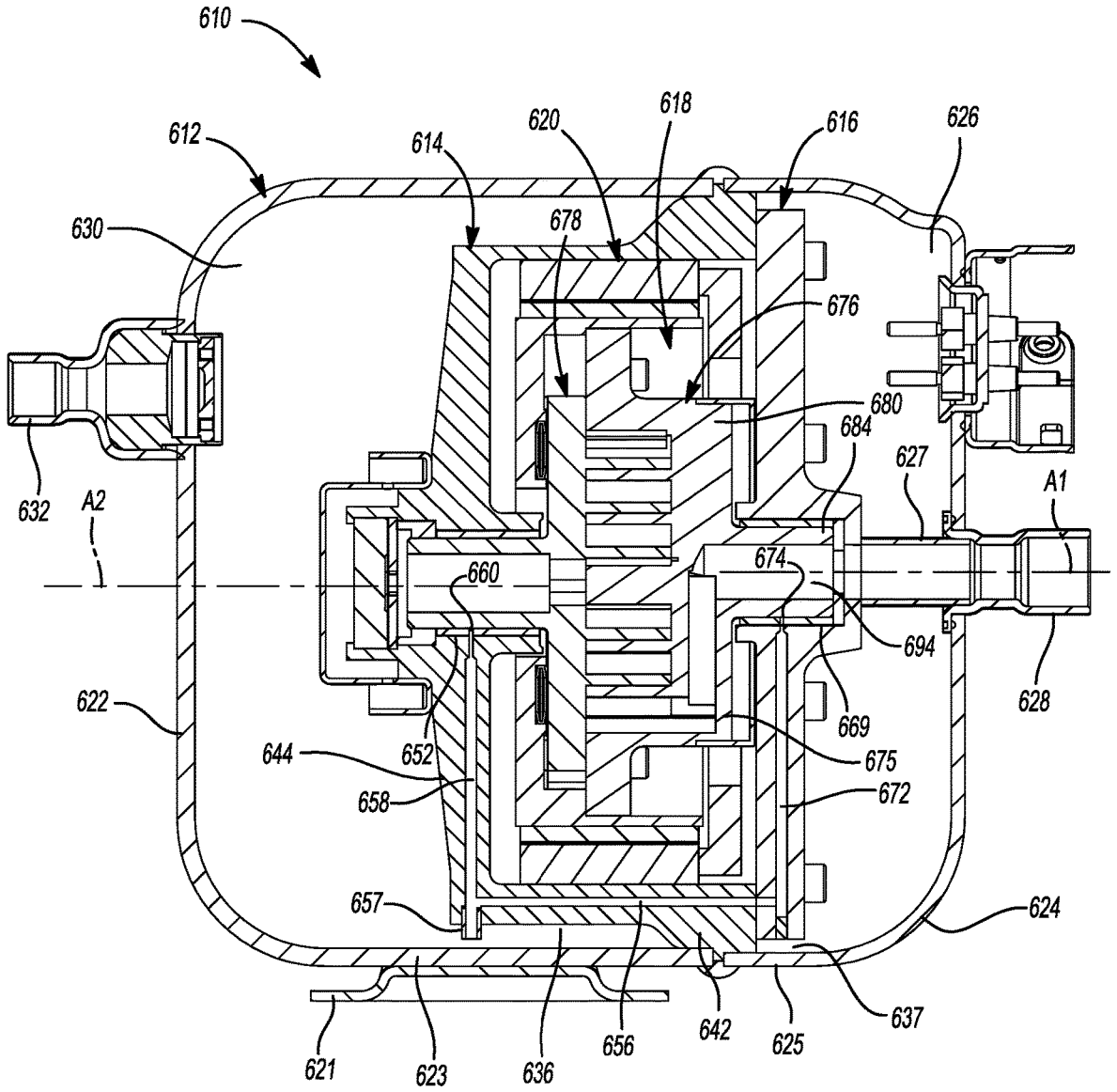
FIG. 6 is another cross-sectional view of the compressor of FIG. 5.

With reference to FIGS. 5 and 6, another compressor 610 is provided that, apart from certain exceptions, may be substantially similar or identical to the compressor 410 described above. Therefore, similar features may not be described again in detail.

Like the compression 410, the compressor 610 may include a shell assembly 612, a first bearing housing 614, a second bearing housing 616, a compression mechanism 618, and a motor assembly 620. While the compressor 410 is a vertical compressor (i.e., the first and second rotational axes A1, A2 about which scroll members 476, 478 rotate extend in the a vertical direction), the compressor 610 is a horizontal compressor (i.e., the first and second rotational axes A1, A2 about which scroll members 676, 678 rotate extend in the a vertical direction).

Like the shell assembly 412, the shell assembly 612 may include a first shell body 622 and a second shell body 624. The second shell body 624 and the first bearing housing 614 may cooperate with each other to define a suction chamber 626 in which the second bearing housing 616, the compression mechanism 618 and the motor assembly 620 may be disposed. A suction inlet fitting 628 may engage the second shell body 624 and may be in fluid communication with a suction conduit 627 coupled with a suction inlet passage 694 formed in a first hub 684 and a first end plate 680 of the first scroll member 676.

The first shell body 622 and the first bearing housing 614 may cooperate with each other to define a discharge chamber 630. A discharge outlet fitting 632 may engage the first shell body 622 and may be in fluid communication with the discharge chamber 630. Discharge-pressure working fluid (i.e., working fluid at a higher pressure than suction pressure) may enter the discharge chamber 630 from the compression mechanism 618 and may exit the compressor 610 through the discharge outlet fitting 632. A cylindrical portion 623 of the first shell body 622 and an annular wall 642 of the first bearing housing 614 may cooperate to define a high-side lubricant sump 636 disposed in the discharge chamber 630. A base 621 may be attached to an outer wall of the cylindrical portion 623 and may support the weight of the compressor 610 relative to a ground surface or other surface upon which the compressor 610 is disposed. A cylindrical portion 625 of the second shell body 624 and periphery of the second bearing housing 616 may cooperate to define a low-side lubricant sump 637 disposed in the suction chamber 626.

Like the first bearing housing 414, the first bearing housing 614 may include an axially extending lubricant passage 656 (FIG. 6) that extends through the annular wall 642 and a flange portion 644 of the first bearing housing 614 and is in fluid communication with the high-side lubricant sump 636 via a lubricant conduit 657 (FIG. 6). The flange portion 644 may also include a first radially extending lubricant passage 658 (FIG. 6) that is in fluid communication with the axially extending lubricant passage 656 and an aperture 660 that extends through a first bearing 652.

Like the second bearing housing 414, the second bearing housing 616 may include a second radially extending lubricant passage 672 (FIG. 6) that is in fluid communication with the axially extending lubricant passage 656 in the first bearing housing 614 and an aperture 674 (FIG. 6) that extends through a second bearing 669. The second bearing housing 616 may also include a third radially extending lubricant passage 673 (FIG. 5) that is in fluid communication with the low-side lubricant sump 637 and a lubricant inlet 675 (FIG. 5) in the first end plate 680. The lubricant inlet 675 allows lubricant from the low-side lubricant sump 637 to flow into a radially outermost fluid pocket (compression pocket) defined by spiral wraps of the first and second scroll members 676, 678.

Figure 7:
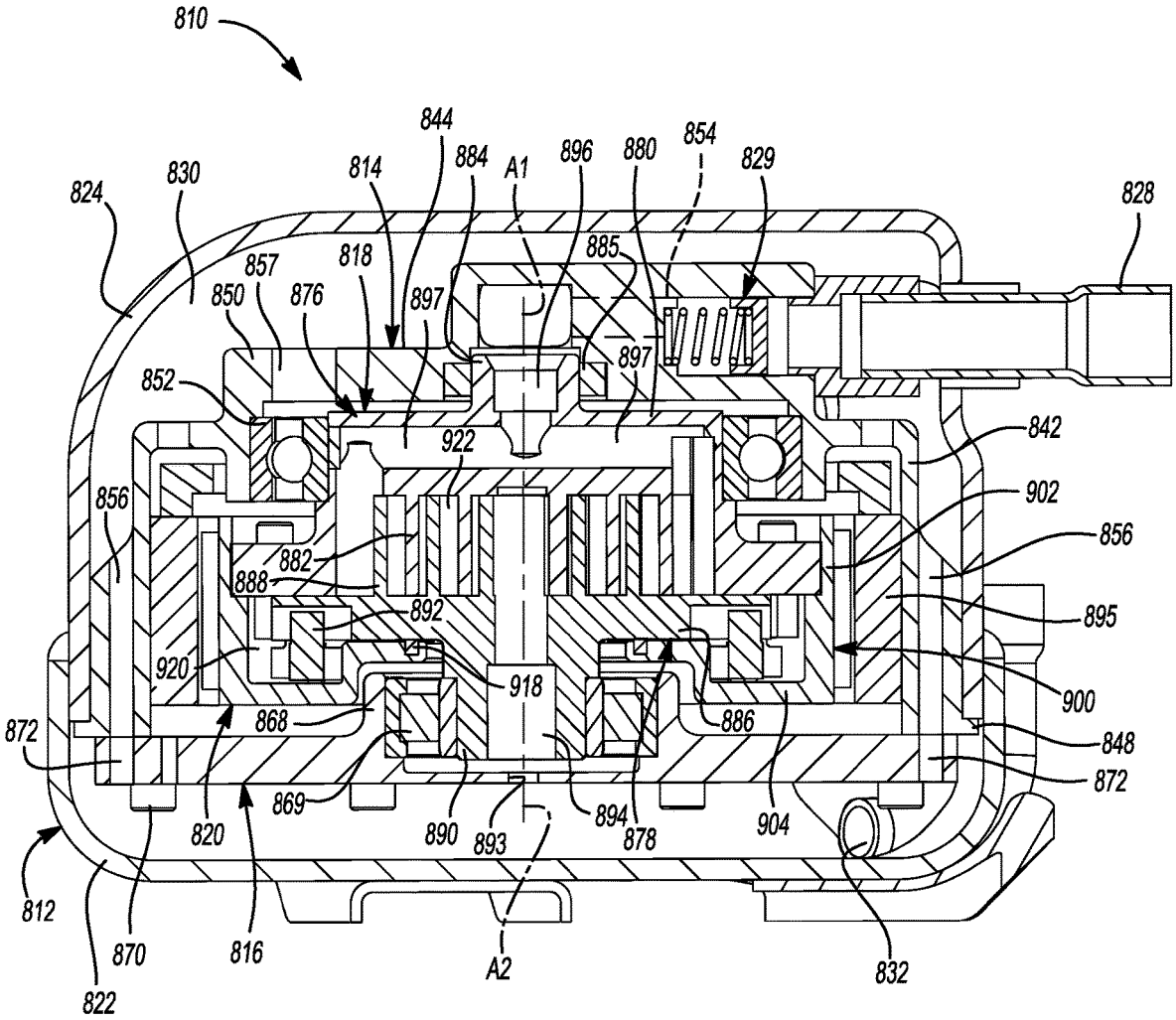
FIG. 7 is a cross-sectional view of yet another compressor according to the principles of the present disclosure.

With reference to FIG. 7, another compressor 810 is provided that may include a shell assembly 812, a first bearing housing 814, a second bearing housing 816, a compression mechanism 818, and a motor assembly 820. The compressor 810 may be a high-side sumpless compressor (i.e., the first bearing housing 814, second bearing housing 816, compression mechanism 818, and motor assembly 820 may be disposed within a discharge chamber 830 defined by the shell assembly 812; and the compressor 810 does not include a lubricant sump).

The shell assembly 812 may include a first shell body 822 and a second shell body 824 that is fixed to the first shell body 822 (e.g., via welding, press fit, etc.). The first and second shell bodies 822, 824 may cooperate with each other to define the discharge chamber 830. A suction inlet fitting 828 may extend through the second shell body 824. A discharge outlet fitting 832 may engage the first shell body 822 and may be in fluid communication with the discharge chamber 830. In some configurations, a discharge valve (e.g., a check valve) may be disposed within the discharge outlet fitting 832.

The first bearing housing 814 may include an annular wall 842 and a radially extending flange portion 844 disposed at an axial end of the annular wall 842. The annular wall 842 may include an outer rim 848 that may be fixed to the second shell body 824. The flange portion 844 may include a central hub 850 that receives a first bearing 852 (e.g., a roller bearing). The central hub 850 may define a suction passage 854 that is fluidly coupled with the suction inlet fitting 828. The compression mechanism 818 may draw suction-pressure working fluid from the suction inlet fitting 828 through the suction passage 854. A suction valve assembly 829 (e.g., a check valve) may be disposed within the suction passage 854. The suction valve assembly 829 allows suction-pressure working fluid to flow through the suction passage 854 toward the compression mechanism 818 and prevents the flow of working fluid in the opposite direction. The first bearing housing 814 may include passages 856 that extend through the annular wall 842 and one or more passages 857 that extend through the flange portion 844 to allow lubricant and working fluid discharged from the compression mechanism 818 to circulate throughout the shell assembly 812 to cool and lubricate moving parts of the compressor 810.

The second bearing housing 816 may be a generally disk-shaped member having a central hub 868 that receives a second bearing 869 (e.g., a roller bearing). The second bearing housing 816 may be fixedly attached to an axial end of the annular wall 842 of the first bearing housing 814 via a plurality of fasteners 870, for example. Passages 872 may extend through the second bearing housing 816 and may be in fluid communication with the passages 856 in the first bearing housing 814 to allow working fluid and lubricant to circulate throughout the shell assembly 812.

The compression mechanism 818 may be a co-rotating scroll compression mechanism including a first scroll member (i.e., a driven scroll member) 876 and a second scroll member (i.e., an idler scroll member) 878. The first scroll member 876 may include a first end plate 880, a first spiral wrap 882 extending from one side of the first end plate 880, and a first hub 884 extending from the opposite side of the first end plate 880. The second scroll member 878 may include a second end plate 886, a second spiral wrap 888 extending from one side of the second end plate 886, and a second hub 890 extending from the opposite side of the second end plate 886.

The first hub 884 of the first scroll member 876 is received within the central hub 850 of the first bearing housing 814. A seal 885 is disposed within the central hub 850 and sealing engages the central hub 850 and the first hub 884. A portion of the first end plate 880 is also received within the central hub 850 and is supported by the first bearing housing 814 and the first bearing 852 for rotation about a first rotational axis A1 relative to the first and second bearing housings 814, 816. The second hub 890 of the second scroll member 878 is received within the central hub 868 of the second bearing housing 816 and is supported by the second bearing housing 816 and the second bearing 869 for rotation about a second rotational axis A2 relative to the first and second bearing housings 814, 816. The second rotational axis A2 is parallel to first rotational axis A1 and is offset from the first rotational axis A1.

An Oldham coupling 892 may be keyed to the second end plate 886 and a rotor 900 of the motor assembly 820. In some configurations, the Oldham coupling 892 could be keyed to the first and second end plates 880, 886. The first and second spiral wraps 882, 888 are intermeshed with each other and cooperate to form a plurality of fluid pockets (i.e., compression pockets) therebetween. Rotation of the first scroll member 876 about the first rotational axis A1 and rotation of the second scroll member 878 about the second rotational axis A2 causes the fluid pockets to decrease in size as they move from a radially outer position to a radially inner position, thereby compressing the working fluid therein from the suction pressure to the discharge pressure.

The first scroll member 876 may include an axially extending suction passage 896 that extends through the first hub 884 and into the first end plate 880. Radially extending suction passages 897 formed in the first end plate 880 extend radially outward from the axially extending suction passage 896 and provide fluid communication between the axially extending suction passage 896 and radially outermost fluid pockets. Accordingly, during operation of the compressor 810, suction-pressure working fluid can be drawn into the suction inlet fitting 828, through the suction passage 854 of the first bearing housing 814, through the axially extending suction passage 896, and then through the radially extending suction passages 897 to the radially outermost fluid pockets defined by the spiral wraps 882, 888.

The second scroll member 878 may include one or more discharge passages 894 that extend through the second end plate 886 and the second hub 890 and provide fluid communication between a radially innermost one of the fluid pockets and the discharge chamber 830. The second bearing housing 816 may include one or more discharge openings 893 providing fluid communication between the discharge passage 894 and the discharge chamber 830.

The structure and function of the motor assembly 820 may be similar or identical to that of the motor assembly 320. Therefore, similar features may not be described in detail again. Like the motor assembly 320, the motor assembly 820 may be a ring motor including a composite stator 895 and a rotor 900. The stator 895 may be fixed to the annular wall 842 of the first bearing housing 814 and may surround the first and second end plates 880, 886 and the first and second spiral wraps 882, 888.

The rotor 900 may be disposed radially inside of the stator 895 and is rotatable relative to the stator 895. Like the rotor 300, the rotor 900 may include an annular axially extending portion 902 and a radially extending portion 904. The axially extending portion 902 may surround the first and second end plates 880, 886 and the first and second spiral wraps 882, 888. The axially extending portion 902 may engage an outer periphery of the first end plate 880. When electrical current is provided to the stator 895, the rotor 900 and the first scroll member 876 rotate about the first rotational axis A1. Such rotation of the first scroll member 876 causes corresponding rotation of the second scroll member 878 about the second rotational axis A2, as described above.

An annular seal 918 may be received in a recess in the radially extending portion 904 and may sealingly engage the radially extending portion 904 and the second end plate 886. The annular seal 918, the first and second end plates 880, 886 and the radially extending portion 904 cooperate to define an annular chamber 920. The annular chamber 920 may receive intermediate-pressure working fluid (at a pressure greater than suction pressure and less than discharge pressure) from an intermediate fluid pocket 922 via a passage in the second end plate 886. Intermediate-pressure working fluid in the annular chamber 920 biases the second end plate 886 in an axial direction (i.e., a direction parallel to the rotational axes A1, A2) toward the first end plate 880 to improve the seal between tips of the first spiral wrap 882 and the second end plate 886 and the seal between tips of the second spiral wrap 888 and the first end plate 880.

Figure 8:
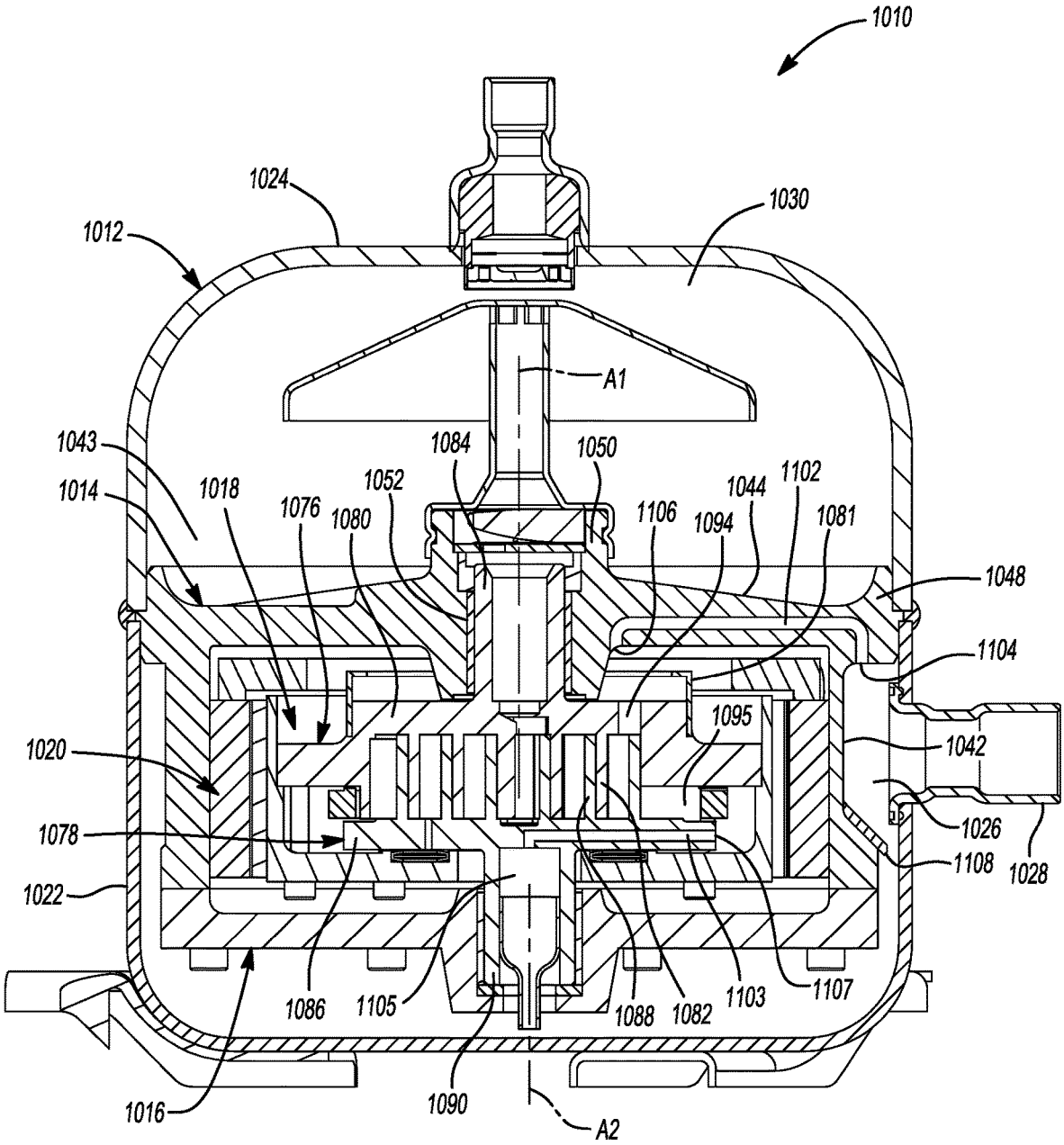
FIG. 8 is a cross-sectional view of yet another compressor according to the principles of the present disclosure.

With reference to FIG. 8, another compression 1010 is provided that may include a shell assembly 1012, a first bearing housing 1014, a second bearing housing 1016, a compression mechanism 1018, and a motor assembly 1020. The structure and function of the shell assembly 1012, first bearing housing 1014, second bearing housing 1016, compression mechanism 1018, and motor assembly 1020 may be similar or identical to that of the shell assembly 12, first bearing housing 14, second bearing housing 16, compression mechanism 18, and motor assembly 20 described above, apart from any exceptions described below. Therefore, similar features might not be described again in detail.

Like the first bearing housing 14, the first bearing housing 1014 may include a generally cylindrical annular wall 1042 and a radially extending flange portion 1044 disposed at an axial end of the annular wall 1042. The flange portion 1044 may include an outer rim 1048 that is welded to (or otherwise fixedly engages) first and second shell bodies 1022, 1024. The flange portion 1044 may cooperate with the second shell body 1024 to define a high-side lubricant sump 1043. The flange portion 1044 may include a central hub 1050 that receives a first bearing 1052. The first bearing housing 1014 cooperates with the second shell body 1024 to define a discharge chamber 1030. The first bearing housing 1014 cooperates with the first shell body 1022 to define a suction chamber 1026.

Like the compression mechanism 18, the compression mechanism 1018 may include a first compression member (e.g., a first scroll member 1076 that rotates about a first rotational axis A1) and a second compression member (e.g., a second scroll member 1078 that rotates about a second rotational axis A2). A first end plate 1080 of the first scroll member 1076 may include a suction inlet opening 1094. The suction inlet opening 1094 may be in fluid communication with a radially outermost compression pocket defined by first and second spiral wraps 1082, 1088 of the first and second scroll members 1076, 1078. An annular shroud 1081 may be mounted to the first end plate 1080 and may extend axially upward therefrom. The annular shroud 1081 may surround the suction inlet opening 1094. That is, the suction inlet opening 1094 may be disposed radially between the annular shroud 1081 and a first hub 1084 of the first scroll member 1076.

The first bearing housing 1014 may include a suction passage 1102 that extends radially through the flange portion 1044 between the outer rim 1048 and the central hub 1050. The suction passage 1102 may include a first end 1104 that is disposed radially outward relative to the annular wall 1042 and a second end 1106 that is disposed radially inward relative to the annular wall 1042. The second end 1106 may be disposed radially inward relative to the annular shroud 1081. In some configurations, the second end 1106 may be generally aligned with the suction inlet opening 1094 or at least partially radially inward relative to the suction inlet opening 1094. The suction passage 1102 may provide suction-pressure working fluid from a portion of the suction chamber 1026 adjacent a suction inlet fitting 1028 of the shell assembly 1012 to a location proximate to the suction inlet opening 1094 (i.e., at a location at or adjacent the central hub 1050 and radially aligned with or radially inward relative to the suction inlet opening 1094). In some configurations, the annular wall 1042 of the first bearing housing 1014 may include a deflector 1108 that routes working fluid from the suction inlet fitting 1028 toward the suction passage 1102.

By routing the working fluid from the suction inlet fitting 1028 to the suction inlet opening 1094 through the suction passage 1102, the working fluid is delivered to the suction inlet opening 1094 more efficiently (i.e., less energy is required to deliver the working fluid to the suction inlet opening 1094). Since the working fluid exits the suction passage 1102 (i.e., through the second end 1106) at a location that is radially inward relative to the suction inlet opening 1094, centrifugal force due to rotation of the first scroll member 1076 forces the working fluid from the suction passage 1102 radially outward and into the suction inlet opening 1094. In other words, in addition to the pressure differential that draws the working fluid toward the radially outermost fluid pocket(s) defined by the spiral wraps 1082, 1088, the centrifugal force due to rotation of the first scroll member 1076 forces the working fluid at the second end 1106 of the suction passage 1102 toward the radially outermost fluid pocket(s).

Furthermore, the working fluid flowing through the suction passage 1102 is shielded from windage produced by the rotation of the first scroll member 1076, the second scroll member 1078 and the rotor of the motor assembly 1020 as the working fluid travels radially inward from the suction inlet fitting 1028 to the suction inlet opening 1094. That is, rotation of the first scroll member 1076, the second scroll member 1078 and the rotor of the motor assembly 1020 causes centrifugal windage (i.e., a rotational vortex) in a radially outward direction. Because the working fluid in the suction passage 1102 is shielded from this windage, the working fluid does not need to overcome the force of the windage to be drawn into the suction inlet opening 1094. To the contrary, routing the working fluid through the suction passage 1102 to a location radially inward of the suction inlet opening 1094 allows the windage produced by the rotation of the first scroll member 1076 to aid induction of the working fluid into the suction inlet opening 1094. Therefore, by routing the working fluid through the suction passage 1102 to a location at or closer to the rotational axis A1, the working fluid is more efficiently delivered to the suction inlet opening 1094. Furthermore, shielding the working fluid from the rotational vortex windage can prevent or reduce warming of the working fluid from heat generated by viscous shear and aerodynamic effects.

In some configurations, a second end plate 1086 of the second scroll 1078 may include a suction passage 1103. The suction passage 1103 may be in fluid communication with an axially extending passage 1105 formed in a second hub 1090 of the second scroll member 1078. The suction passage 1103 extends radially outward from the axially extending passage 1105. A radially outward end 1107 of the suction passage 1103 may be disposed adjacent to a suction inlet opening 1095 defined by the first scroll member 1076 and/or the second scroll member 1078. Working fluid in the suction chamber 1026 may flow into the axially extending passage 1105, through the suction passage 1103 and into the suction inlet opening 1095 to a radially outermost fluid pocket. In a similar manner as described above, routing the working fluid through the passages 1105, 1103 allows centrifugal force to aid in the induction of the working fluid and shields the working fluid from windage generated by rotation of the first and second scroll members 1076, 1078.

While the compressor 1010 shown in FIG. 8 includes both of the suction passages 1102, 1103 and both of the suction inlet openings 1094, 1095, in some configurations, the compressor 1010 may include only one of the suction passages 1102, 1103 and only one of the suction inlet openings 1094, 1095.

Figure 9:
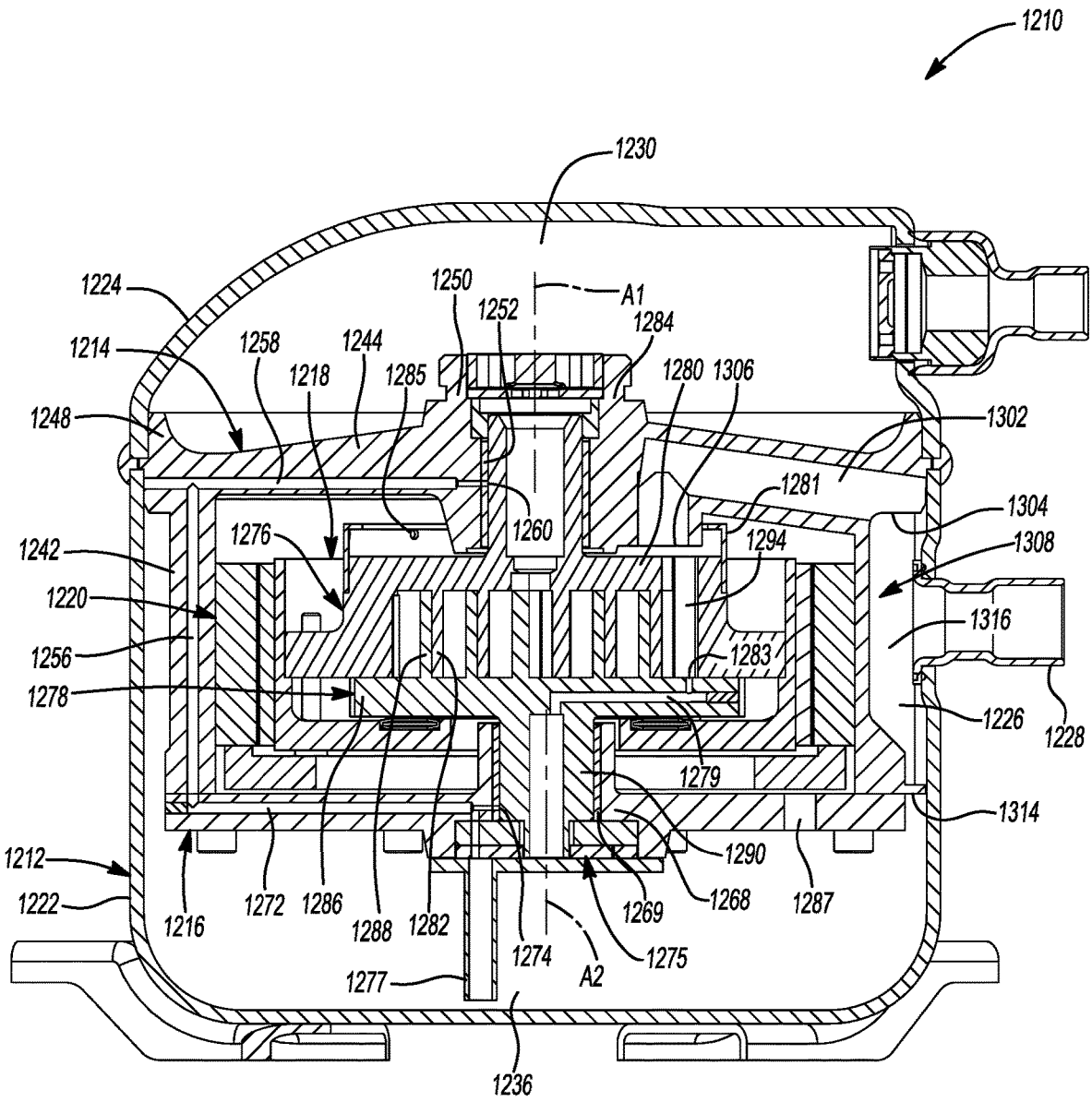
FIG. 9 is a cross-sectional view of yet another compressor according to the principles of the present disclosure.
Figure 10:
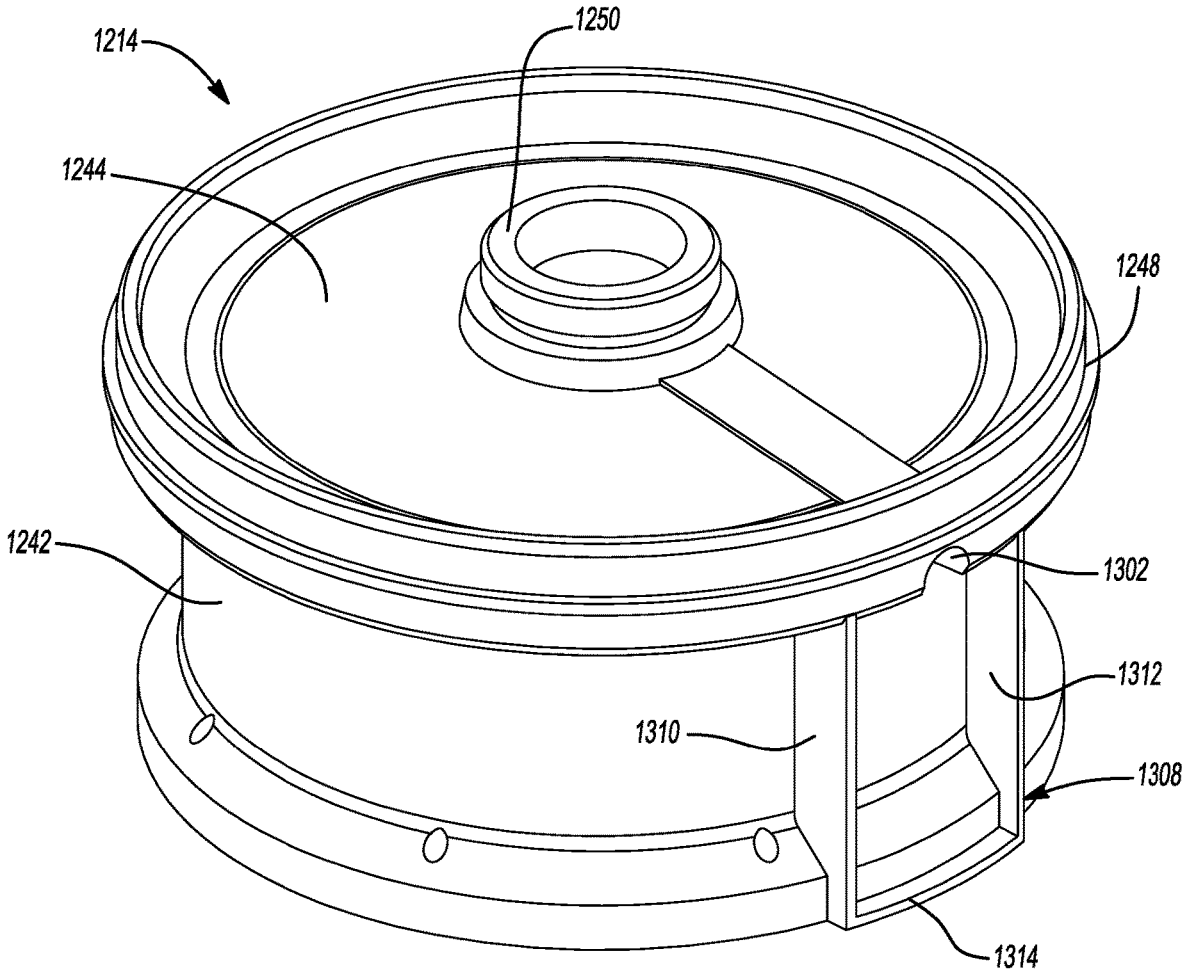
FIG. 10 is a perspective view of a bearing housing of the compressor of FIG. 9.

With reference to FIGS. 9 and 10, another compressor 1210 is provided that may include a shell assembly 1212, a first bearing housing 1214, a second bearing housing 1216, a compression mechanism 1218, and a motor assembly 1220. The structure and function of the shell assembly 1212, first bearing housing 1214, second bearing housing 1216, compression mechanism 1218, and motor assembly 1220 may be similar or identical to that of the shell assembly 12, first bearing housing 14, second bearing housing 16, compression mechanism 18, and motor assembly 20 described above, apart from any exceptions described below. Therefore, similar features might not be described again in detail.

Like the first bearing housing 14, the first bearing housing 1214 may include a generally cylindrical annular wall 1242 and a radially extending flange portion 1244 disposed at an axial end of the annular wall 1242. The flange portion 1244 may include an outer rim 1248 that is welded to (or otherwise fixedly engages) first and second shell bodies 1222, 1224. The flange portion 1244 may include a central hub 1250 that receives a first bearing 1252. The first bearing housing 1214 cooperates with the second shell body 1224 to define a discharge chamber 1230. The first bearing housing 1214 cooperates with the first shell body 1222 to define a suction chamber 1226.

The first bearing housing 1214 may include an axially extending lubricant passage 1256 that extends through the annular wall 1242 and the flange portion 1244 and is in fluid communication with a lubricant sump 1236 defined by the first shell body 1222. The flange portion 1244 may also include a first radially extending lubricant passage 1258 that is in fluid communication with the axially extending lubricant passage 1256 and an aperture 1260 that extends through the first bearing 1252.

Like the compression mechanism 18, the compression mechanism 1218 may include a first compression member (e.g., a first scroll member 1276 that rotates about a first rotational axis A1) and a second compression member (e.g., a second scroll member 1278 that rotates about a second rotational axis A2). A first end plate 1280 of the first scroll member 1276 may include a suction inlet opening 1294. The suction inlet opening 1294 may be in fluid communication with a radially outermost compression pocket defined by first and second spiral wraps 1282, 1288 of the first and second scroll members 1276, 1278. An annular shroud 1281 may be mounted to the first end plate 1280 and may extend axially upward therefrom. The annular shroud 1281 may surround the suction inlet opening 1294. That is, the suction inlet opening 1294 may be disposed radially between the annular shroud 1281 and a first hub 1284 of the first scroll member 1276.

The first bearing housing 1214 may include a suction passage 1302 that extends radially through the flange portion 1244 between the outer rim 1248 and the central hub 1250. The suction passage 1302 may include a first end 1304 that is disposed radially outward relative to the annular wall 1242 and a second end 1306 that is disposed radially inward relative to the annular wall 1242. The second end 1306 may be disposed radially inward relative to the annular shroud 1281. In some configurations, the second end 1306 may be generally aligned with the suction inlet opening 1294 or at least partially radially inward relative to the suction inlet opening 1294. The suction passage 1302 may provide suction-pressure working fluid from a portion of the suction chamber 1226 adjacent a suction inlet fitting 1228 of the shell assembly 1212 to a location proximate to the suction inlet opening 1294 (i.e., at a location at or adjacent the central hub 1250 and radially aligned with or radially inward relative to the suction inlet opening 1294).

In some configurations, the first bearing housing 1214 may include a suction baffle 1308 that routes working fluid from the suction inlet fitting 1228 toward the suction passage 1302. The suction baffle 1308 may include the annular wall 1242 of the first bearing housing 1214, a first wall 1310 protruding radially outward from the annular wall 1242, a second wall 1312 protruding radially outward from the annular wall 1242, and a lip 1314 protruding radially outward from the annular wall 1242 and extending between the first and second walls 1310, 1312. Radially outer edges of the first and second walls 1310, 1312 and the lip 1314 may contact the first shell body 1222 to form an enclosed volume 1316 within the suction chamber 1226. The enclose volume 1316 is in fluid communication with the suction inlet fitting 1228 and the suction passage 1302. The first end 1304 of the suction passage 1302 may be disposed between the first and second walls 1310, 1312. The suction baffle 1308 directs working fluid from the suction inlet fitting 1228 to suction passage 1304.

As described above, by routing the working fluid from the suction inlet fitting 1228 to the suction inlet opening 1294 through the suction passage 1302, the working fluid is delivered to the suction inlet opening 1294 more efficiently. Since the working fluid exits the suction passage 1302 (i.e., through the second end 1306) at a location that is radially inward relative to the suction inlet opening 1294, centrifugal force due to rotation of the first scroll member 1276 forces the working fluid from the suction passage 1302 radially outward and into the suction inlet opening 1294. In other words, in addition to the pressure differential that draws the working fluid toward the radially outermost fluid pocket(s) defined by the spiral wraps 1282, 1288, the centrifugal force due to rotation of the first scroll member 1276 forces the working fluid at the second end 1306 of the suction passage 1302 toward the radially outermost fluid pocket(s).

Furthermore, the working fluid flowing through the suction passage 1302 is shielded from windage produced by the rotation of the first scroll member 1276, the second scroll member 1278 and the rotor of the motor assembly 1220 as the working fluid travels radially inward from the suction inlet fitting 1228 to the suction inlet opening 1294. That is, rotation of the first scroll member 1276, the second scroll member 1078 and the rotor of the motor assembly 1020 causes centrifugal windage (i.e., a rotational vortex) in a radially outward direction. Because the working fluid in the suction passage 1302 shielded from this windage, the working fluid does not need to overcome the force of the windage to be drawn into the suction inlet opening 1294. To the contrary, routing the working fluid through the suction passage 1302 to a location radially inward of the suction inlet opening 1294 allows the windage produced by the rotation of the first scroll member 1276 to aid induction of the working fluid into the suction inlet opening 1294. Therefore, by routing the working fluid through the suction passage 1302 to a location at or closer to the rotational axis A1, the working fluid is more efficiently delivered to the suction inlet opening 1294. Furthermore, shielding the working fluid from the rotational vortex windage can prevent or reduce warming of the working fluid from heat generated by viscous shear and aerodynamic effects.

The second bearing housing 1216 may include a second radially extending lubricant passage 1272 that is in fluid communication with the axially extending lubricant passage 1256 in the first bearing housing 1214 and an aperture 1274 that extends through a second bearing 1269 mounted with a central hub 1268 of the second bearing housing 1216. The second radially extending lubricant passage 1272 may receive lubricant from a lubricant pump 1275 that draws lubricant from the lubricant sump 1236 through a conduit 1277. From the second radially extending lubricant passage 1272, lubricant can flow through the aperture 1274 to the second bearing 1269 and through the axially extending lubricant passage 1256 and the first radially extending lubricant passage 1258 and aperture 1260 to the first bearing 1252. Furthermore, the pump 1275 may pump lubricant through a lubricant passage 1279 that extends axially through a second hub 1290 of the second scroll member 1278 and radially outward through a second end plate 1286 of the second scroll member 1278. The lubricant passage 1279 in the second scroll member 1278 may be in communication with a compression pocket defined by spiral wraps 1282, 1288 via a lubricant-injection port 1283.

Rotation of the scroll members 1276, 1278 causes lubricant to separate from the working fluid. Centrifugal force may cause separated lubricant to flow through a plurality of apertures 1285 in the shroud 1281 and fall onto the motor assembly 1220 and cool the motor assembly 1220 before draining through a lubricant drain aperture 1287 in the second bearing housing 1216 back into the lubricant sump 1236.

The motor assemblies 20, 220, 420, 620, 820, 1020, 1220 described above may be fixed-speed, multi-speed, or variable-speed motors. The ring-motor designs of the motor assemblies 20, 220, 420, 620, 820, 1020, 1220 allow the motor assemblies 20, 220, 420, 620, 820, 1020, 1220 to be more axially compact, powerful and light weight. The configuration of the stators and rotors described above and shown in the figures allow the compression members to be disposed within the rotor (i.e., the rotor radially surrounding the compression members). This allows the overall axial height of the compressors 10, 210, 410, 610, 810, 1010, 1210 to be significantly smaller than conventional compressors. The reduced axial height of the compressors 10, 210, 410, 610, 810, 1010, 1210 allows the compressors 10, 210, 410, 610, 810, 1010, 1210 to be packaged into smaller spaces within a climate-control system.

Furthermore, since the compression mechanisms and motor assemblies described above are mounted to the first and second bearing housings (rather than to the shell assembly), the compression mechanisms and motor assemblies can be assembled to the bearing housings outside of the shell assembly and tested outside of the shell assembly (i.e., prior to being installed within the shell assembly). Testing of the compression mechanism and motor assembly before being installed into the shell assembly allows for any necessary corrections and/or replacement of faulty components without having to break open a shell assembly that has been welded shut.

While the compressors 10, 210, 410, 610, 810, 1010, 1210 described above and shown in the figures are co-rotating scroll compressors, the principles of the present disclosure may be applicable to other types of compressors, such as orbiting scroll compressors, rotary compressors, screw compressors, Wankel compressors, and reciprocating compressors, for example.

Furthermore, while the compressors 10, 210, 410, 610, 810, 1010, 1210 are described above as including an Oldham coupling that transmits motion of the first scroll member 76, 276, 476, 676, 876, 1076, 1276 to the second scroll member 78, 278, 478, 678, 878, 1078, 1278, in some configurations, the compressors 10, 210, 410, 610, 810, 1010, 1210 could include other types of transmission mechanisms instead of an Oldham coupling. For example, the compressors 10, 210, 410, 610, 810, 1010, 1210 could include a transmission mechanism that includes a plurality of pins attached to and extending axially from the first end plate of first scroll member. Each of the pins may be received with an off-center (i.e., eccentric) aperture in a cylindrical disk. The disks may be rotatably received in a corresponding one of a plurality of recesses formed in the second end plate of the second scroll member. The recesses may be positioned such that they are angularly spaced apart from each other in a circular pattern that surrounds the second rotational axis.

The entire disclosures of each of Applicant's commonly owned U.S. Patent Application Publication No. 2018/0223848, U.S. Patent Application Publication No. 2018/0224171, U.S. Patent Application Publication No. 2018/0223842 and U.S. Patent Application Publication No. 2018/0223849 are incorporated herein by reference.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways.

Such variations are not to be regarded as a departure from the disclosure, and all such modifications are intended to be included within the scope of the disclosure.

What is claimed is:

1. A compressor comprising:

a first scroll member having a first end plate and a first spiral wrap extending from the first end plate;

a second scroll member having a second end plate and a second spiral wrap extending from the second end plate and intermeshed with the first spiral wrap to define compression pockets therebetween;

a first bearing housing supporting the first scroll member for rotation about a first rotational axis;

a second bearing housing supporting the second scroll member for rotation about a second rotational axis that is parallel to the first rotational axis and offset from the first rotational axis; and a motor assembly disposed axially between the first and second bearing housings and including a rotor attached to the first scroll member, the rotor surrounding the first end plate and the second end plate, wherein the first bearing housing includes a radially extending suction passage providing fluid communication between a suction inlet of a shell of the compressor and a suction inlet opening in the first end plate, wherein a first end of the radially extending suction passage of the first bearing housing is disposed radially outward relative to the suction inlet opening of the first end plate, and wherein a second end of the radially extending suction passage of the first bearing housing is disposed radially inward relative to the suction inlet opening of the first end plate such that working fluid exits the radially extending suction passage at a location that is disposed radially inward relative to the suction inlet opening such that windage produced by rotation of the first scroll member aids in forcing the working fluid radially outward toward the suction inlet opening.

2. The compressor of claim 1, wherein the rotor includes a radially extending portion that extends radially relative to the first rotational axis and an axially extending portion that extends parallel to the first rotational axis.

3. The compressor of claim 2, wherein the axially extending portion engages the first end plate and surrounds the second scroll member.

4. The compressor of claim 3, further comprising a seal engaging the rotor and the second scroll member, wherein the radially extending portion engages the seal, and wherein the second end plate is disposed between the first end plate and the radially extending portion in a direction extending along the first rotational axis.

5. The compressor of claim 4, wherein the radially extending portion includes an annular recess that encircles the first and second rotational axes, and wherein the seal is at least partially disposed within the annular recess.

6. The compressor of claim 5, wherein the annular recess is in fluid communication with a passage formed in the second end plate, wherein the passage is in fluid communication with intermediate-pressure fluid in one of the compression pockets, wherein the intermediate-pressure fluid is at a pressure greater than a suction pressure at which the fluid enters the compressor and less than a discharge pressure at which the fluid exits the compressor, and wherein the intermediate-pressure fluid in the recess biases the second end plate in an axial direction toward the first end plate and away from the radially extending portion of the rotor.

7. The compressor of claim 1, wherein the shell cooperates with the first bearing housing to define a discharge chamber and a suction chamber, wherein the discharge chamber receives fluid discharged from a radially inner one of the compression pockets, wherein the suction chamber provides fluid to a radially outer one of the compression pockets, and wherein the first bearing housing defines a high-side lubricant sump disposed within the discharge chamber.

8. The compressor of claim 1, wherein the first bearing housing includes a flange portion and an annular wall, the annular wall surrounding the first end plate, the flange portion disposed at an axial end of the annular wall and including a central hub that rotatably supports the first scroll member, wherein the radially extending suction passage extends radially through the flange portion, and wherein the first end of the radially extending suction passage is disposed radially outward relative to the annular wall and the second end of the radially extending suction passage is disposed radially inward of the annular wall.

9. The compressor of claim 8, wherein the annular wall defines a suction baffle that directs working fluid from the suction inlet of the shell to the radially extending suction passage, and wherein the first end of the radially extending suction passage is disposed between first and second walls of the suction baffle.

10. The compressor of claim 8, wherein the second end of the radially extending suction passage is disposed radially inward relative to an annular shroud mounted to the first end plate.

11. A compressor comprising:

a shell;

a first compression member disposed within the shell and rotating relative to the shell about a first rotational axis;

a second compression member disposed within the shell and cooperating with the first compression member to define compression pockets therebetween;

a motor assembly disposed within the shell and drivingly coupled to the first compression member, the motor assembly including a rotor attached to the first compression member and surrounding at least a portion of the first compression member and at least a portion of the second compression member, the rotor includes an axially extending portion and a radially extending portion, the axially extending portion extends parallel to the first rotational axis and engages the first compression member, the radially extending portion extends radially inward from an axial end of the axially extending portion, wherein the first and second compression members are first and second scroll members each having an end plate and a spiral wrap extending from the end plate, and wherein the end plate of the second scroll member is disposed between the end plate of the first scroll member and the radially extending portion of the rotor in a direction extending along the first rotational axis; and a first bearing housing supporting the first scroll member for rotation about a first rotational axis, the first bearing housing including a radially extending suction passage providing fluid communication between a suction inlet of the shell and a suction inlet opening in the end plate of the first scroll member, wherein the first bearing housing includes a flange portion and an annular wall, the annular wall surrounding the end plate of the first scroll member, the flange portion disposed at an axial end of the annular wall and including a central hub that rotatably supports the first scroll member, and wherein the radially extending suction passage extends radially through the flange portion and includes a first end disposed radially outward relative to the annular wall and a second end disposed radially inward of the annular wall and radially inward relative to an annular shroud mounted to the end plate of the first scroll member.

12. The compressor of claim 11, wherein the annular wall defines a suction baffle that directs working fluid from the suction inlet of the shell to the radially extending suction passage, and wherein the first end of the radially extending suction passage is disposed between first and second walls of the suction baffle.

13. The compressor of claim 11, further comprising a seal engaging the rotor and the second scroll member, wherein the radially extending portion engages the seal.

14. The compressor of claim 13, wherein the radially extending portion includes an annular recess that encircles the first and second rotational axes, and wherein the seal is at least partially disposed within the annular recess.

15. The compressor of claim 14, wherein the annular recess is in fluid communication with a passage formed in the second end plate, wherein the passage is in fluid communication with intermediate-pressure fluid in one of the compression pockets, wherein the intermediate-pressure fluid is at a pressure greater than a suction pressure at which the fluid enters the compressor and less than a discharge pressure at which the fluid exits the compressor, and wherein the intermediate-pressure fluid in the recess biases the second end plate in an axial direction toward the first end plate and away from the radially extending portion of the rotor.

* * * * *